US008905139B2

(12) United States Patent
Arizmendi, Jr. et al.

(10) Patent No.: US 8,905,139 B2
(45) Date of Patent: Dec. 9, 2014

(54) BLAPPER VALVE TOOLS AND RELATED METHODS

(75) Inventors: Napoleon Arizmendi, Jr., Magnolia, TX (US); Richard Paul Rubbo, The Woodlands, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/266,120

(22) PCT Filed: Apr. 26, 2010

(86) PCT No.: PCT/US2010/001230
§ 371 (c)(1),
(2), (4) Date: Oct. 24, 2011

(87) PCT Pub. No.: WO2010/123585
PCT Pub. Date: Oct. 28, 2010

(65) Prior Publication Data
US 2012/0043092 A1 Feb. 23, 2012

Related U.S. Application Data

(60) Provisional application No. 61/172,676, filed on Apr. 24, 2009.

(51) Int. Cl.

| | |
|---|---|
| ***E21B 34/00*** | (2006.01) |
| ***E21B 34/06*** | (2006.01) |
| ***E21B 41/00*** | (2006.01) |
| ***E21B 23/04*** | (2006.01) |

(52) U.S. Cl.
CPC ..... *E21B 34/06* (2013.01); *E21B 2034/002* (2013.01); *E21B 41/00* (2013.01); *E21B 23/04* (2013.01); *E21B 34/066* (2013.01); *E21B 2034/005* (2013.01)
USPC ..... 166/332.2; 166/332.3; 166/332.8; 166/317; 166/376

(58) Field of Classification Search
USPC ..... 166/369, 330, 332.2, 332.3, 332.8, 281, 166/308.1, 317, 376
See application file for complete search history.

(56) References Cited

U.S. PATENT DOCUMENTS

| | | | |
|---|---|---|---|
| 2,067,408 | A | 1/1937 | Morris |
| 2,925,775 | A | 2/1960 | McKee |
| 2,968,243 | A | 1/1961 | Turechek |
| 2,986,214 | A | 5/1961 | Wiseman, Jr. et al. |
| 3,028,914 | A | 4/1962 | Flickinger |
| 3,111,988 | A | 11/1963 | Davis et al. |
| 3,118,501 | A | 1/1964 | Kenley |
| 3,366,188 | A | 1/1968 | Hicks |
| 3,427,652 | A | 2/1969 | Seay |
| 3,429,384 | A | 2/1969 | Shore |

(Continued)

FOREIGN PATENT DOCUMENTS

| | | |
|---|---|---|
| EP | 1062405 | 6/2003 |
| RU | 2114284 | 6/1998 |
| WO | 2007003597 | 1/2007 |

*Primary Examiner* — Cathleen Hutchins
*Assistant Examiner* — Taras P Bemko
(74) *Attorney, Agent, or Firm* — Ramey & Browning, PLLC

(57) ABSTRACT

Various embodiments of the present invention disclose enhanced and improved well production tools for increasing the stability of production zones in a wellbore. Various embodiments of the present invention generally relate to apparatuses, systems, and processes for efficiently and effectively isolating zones within a wellbore.

19 Claims, 12 Drawing Sheets

(56) References Cited

U.S. PATENT DOCUMENTS

| | | | | |
|---|---|---|---|---|
| 3,547,198 | A | 12/1970 | Slusser | |
| 3,662,833 | A | 5/1972 | Kisling, III | |
| 3,712,379 | A | 1/1973 | Hill | |
| 3,739,723 | A | 6/1973 | Hakala | |
| 3,874,461 | A | 4/1975 | Cocanower | |
| 4,102,401 | A | 7/1978 | Erbstoesser | |
| 4,113,314 | A | 9/1978 | Savanick et al. | |
| 4,137,182 | A | 1/1979 | Golinkin | |
| 4,139,060 | A | 2/1979 | Muecke et al. | |
| 4,244,425 | A | 1/1981 | Erbstoesser | |
| 4,415,035 | A | 11/1983 | Medlin et al. | |
| 4,557,325 | A | 12/1985 | Gall | |
| 4,559,786 | A | 12/1985 | Schuck | |
| 4,633,954 | A | 1/1987 | Dixon et al. | |
| 4,637,468 | A | 1/1987 | Derrick | |
| 4,671,352 | A | 6/1987 | Magee, Jr. et al. | |
| 4,702,316 | A | 10/1987 | Chung et al. | |
| 4,776,393 | A | 10/1988 | Forehand et al. | |
| 4,791,990 | A | 12/1988 | Amani | |
| 4,809,781 | A | 3/1989 | Hoefner | |
| 4,852,391 | A | 8/1989 | Ruch et al. | |
| 4,860,831 | A | 8/1989 | Caillier | |
| 4,865,131 | A | 9/1989 | Moore et al. | |
| 4,867,241 | A | 9/1989 | Strubhar | |
| 5,025,861 | A | 6/1991 | Huber et al. | |
| 5,103,912 | A | 4/1992 | Flint | |
| 5,131,472 | A | 7/1992 | Dees et al. | |
| 5,161,618 | A | 11/1992 | Jones et al. | |
| 5,309,995 | A | 5/1994 | Gonzalez et al. | |
| 5,314,019 | A | 5/1994 | Honarpour | |
| 5,353,875 | A | 10/1994 | Schultz et al. | |
| 5,390,741 | A | 2/1995 | Payton et al. | |
| 5,475,882 | A | 12/1995 | Sereboff | |
| 5,513,703 | A | 5/1996 | Mills et al. | |
| 5,579,844 | A | 12/1996 | Rebardi et al. | |
| 5,598,891 | A | 2/1997 | Snider et al. | |
| 5,669,448 | A | 9/1997 | Minthorn et al. | |
| 5,673,658 | A | 10/1997 | Allmendinger | |
| 5,704,426 | A | 1/1998 | Rytlewski et al. | |
| 5,755,286 | A | 5/1998 | Ebinger | |
| 5,803,178 | A | 9/1998 | Cain | |
| 5,812,068 | A | 9/1998 | Wisler et al. | |
| 5,832,998 | A | 11/1998 | Decker et al. | |
| 5,845,712 | A | 12/1998 | Griffith, Jr. | |
| 5,865,252 | A | 2/1999 | van Petegem et al. | |
| 5,884,703 | A * | 3/1999 | Garcia-Soule et al. | 166/356 |
| 5,890,536 | A | 4/1999 | Nierode et al. | |
| 5,921,318 | A | 7/1999 | Ross | |
| 5,934,377 | A | 8/1999 | Savage | |
| 5,947,200 | A | 9/1999 | Montgomery | |
| 5,954,133 | A | 9/1999 | Ross | |
| 5,990,051 | A | 11/1999 | Ischy et al. | |
| 5,996,687 | A | 12/1999 | Pringle et al. | |
| 6,003,607 | A | 12/1999 | Hagen et al. | |
| 6,012,525 | A | 1/2000 | Burleson et al. | |
| 6,053,248 | A | 4/2000 | Ross | |
| 6,065,536 | A | 5/2000 | Gudmestad et al. | |
| 6,092,599 | A | 7/2000 | Berry et al. | |
| 6,098,713 | A | 8/2000 | Ross | |
| 6,116,343 | A | 9/2000 | Van Petegem et al. | |
| 6,131,662 | A | 10/2000 | Ross | |
| 6,186,227 | B1 | 2/2001 | Vaynshteyn et al. | |
| 6,186,230 | B1 | 2/2001 | Nierode | |
| 6,186,236 | B1 | 2/2001 | Cox | |
| 6,189,621 | B1 | 2/2001 | Vail, III | |
| 6,241,013 | B1 | 6/2001 | Martin | |
| 6,257,332 | B1 | 7/2001 | Vidrine et al. | |
| 6,257,338 | B1 | 7/2001 | Kilgore | |
| 6,272,434 | B1 | 8/2001 | Wisler et al. | |
| 6,286,598 | B1 | 9/2001 | van Petegem et al. | |
| 6,296,066 | B1 | 10/2001 | Terry et al. | |
| 6,394,184 | B2 | 5/2002 | Tolman et al. | |
| 6,408,942 | B2 | 6/2002 | Martin | |
| 6,446,727 | B1 | 9/2002 | Zemlak et al. | |
| 6,474,419 | B2 | 11/2002 | Maier et al. | |
| 6,488,082 | B2 | 12/2002 | Echols et al. | |
| 6,494,260 | B2 | 12/2002 | van Petegem et al. | |
| 6,497,284 | B2 | 12/2002 | van Petegem et al. | |
| 6,497,290 | B1 | 12/2002 | Misselbrook et al. | |
| 6,520,255 | B2 | 2/2003 | Tolman et al. | |
| 6,543,538 | B2 | 4/2003 | Tolman et al. | |
| 6,543,540 | B2 | 4/2003 | Woie et al. | |
| 6,547,011 | B2 | 4/2003 | Kilgore | |
| 6,575,247 | B2 | 6/2003 | Tolman et al. | |
| 6,631,772 | B2 | 10/2003 | Palaschenko | |
| 6,732,803 | B2 | 5/2004 | Garcia et al. | |
| 6,808,020 | B2 | 10/2004 | Garcia et al. | |
| 6,957,701 | B2 | 10/2005 | Tolman et al. | |
| 6,973,973 | B2 | 12/2005 | Howard et al. | |
| 7,059,407 | B2 | 6/2006 | Tolman et al. | |
| 7,114,558 | B2 | 10/2006 | Hoffman et al. | |
| 7,267,172 | B2 * | 9/2007 | Hofman | 166/281 |
| 7,426,938 | B2 | 9/2008 | Bohaychuk et al. | |
| 7,658,229 | B2 | 2/2010 | Becker et al. | |
| 7,717,182 | B2 | 5/2010 | Butler et al. | |
| 7,802,625 | B2 | 9/2010 | Daniels et al. | |
| 2003/0141073 | A1 | 7/2003 | Kelley | |
| 2006/0124311 | A1 * | 6/2006 | Lopez de Cardenas et al. | 166/313 |
| 2007/0204999 | A1 * | 9/2007 | Cowie et al. | 166/368 |
| 2008/0053658 | A1 * | 3/2008 | Wesson et al. | 166/297 |
| 2008/0053662 | A1 * | 3/2008 | Williamson et al. | 166/381 |

* cited by examiner

BLAPPER VALVE TOOLS AND RELATED METHODS

RELATED APPLICATIONS

This application claims priority to U.S. Provisional Patent Application 61/172,676 filed on Apr. 24, 2009, which is specifically incorporated by reference in its entirety herein without disclaimer. This application is further related to a copending application titled NEW AND IMPROVED FRACTURE VALVE TOOLS AND RELATED METHODS and a copending application titled NEW AND IMPROVED ACTUATORS AND RELATED METHODS, both filed this same day.

FIELD OF THE INVENTION

The present invention relates to a method for treating oil and gas wells. More specifically, various embodiments of the present invention provide novel and non-obvious apparatuses, systems, and processes for enhanced production of hydrocarbon streams. More specifically, various embodiments of the present invention generally relate to apparatuses, systems, and processes for efficiently and effectively isolating zones within a wellbore.

BACKGROUND OF THE INVENTION

Hydrocarbon fluids such as oil and natural gas are obtained from a subterranean geologic formation, referred to as a reservoir; by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

The completion can include operations such as the perforating of wellbore casing, acidizing and fracturing the producing formation, and gravel packing the annulus area between the production tubulars and the wellbore wall. For use in multi-zone completions where it is required to perform fracture stimulation treatments on separate zones.

Likewise, when a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity. A wellbore penetrating a subterranean formation typically consists of a metal pipe (casing) cemented into the original drill hole. Holes (perforations) are placed to penetrate through the casing and the cement sheath surrounding the casing to allow hydrocarbon flow into the wellbore and, if necessary, to allow treatment fluids to flow from the wellbore into the formation.

Hydraulic fracturing consists of injecting fluids (usually viscous shear thinning, non-Newtonian gels or emulsions) into a formation at such high pressures and rates that the reservoir rock fails and forms a plane, typically vertical, fracture (or fracture network) much like the fracture that extends through a wooden log as a wedge is driven into it. Granular proppant material, such as sand, ceramic beads, or other materials, is generally injected with the later portion of the fracturing fluid to hold the fracture(s) open after the pressure is released. Increased flow capacity from the reservoir results from the easier flow path left between grains of the proppant material within the fracture(s). In chemical stimulation treatments, flow capacity is improved by dissolving materials in the formation or otherwise changing formation properties.

When multiple hydrocarbon-bearing zones are stimulated by hydraulic fracturing or chemical stimulation treatments, economic and technical gains are realized by injecting multiple treatment stages that can be diverted (or separated) by various means, including mechanical devices such as bridge plugs, packers, downhole valves, sliding sleeves, and baffle/plug combinations; ball sealers; particulates such as sand, ceramic material, proppant, salt, waxes, resins, or other compounds; or by alternative fluid systems such as viscosified fluids, gelled fluids, foams, or other chemically formulated fluids; or using limited entry methods.

A typical approach is to drill and case with cement through the various zones of interest. Then the operator will work from the bottom of the well or from the lowest production zone:

1. Perforate zone;
2. Fracture or stimulate zone;
3. Flow back and clean-up debris in the production test zone.
4. Plug the zone to keep it isolated.

There are numerous plugs that can be used, including, but not limited to, a cast iron bridge plug (which is drillable); a retrievable bridge plug (which is retrievable); a composite bridge plug (which is drillable); a cement plug; and/or the like.

In general, the process is repeated going back uphole at each production zone where production is desired. There can be as few as one zone and an infinite maximum number of zones. Typically, at the uphole most zone, the step of plugging the zone is skipped.

To begin production from all of the plugged zones, a drill string is lowered with a mill or cutter to mill or drill through all the various plugs at the different zones, wherein all milled zones are allowed to be in communication with the wellbore.

The completion is then set in the wellbore and the well put on production. In various embodiments, a completion is as simple as production tubing terminated into a packer above the top zone. Or, it could consist of a series of packing placed between each set of parts connected by tubing with valves in between. The valves or controllers are capable of being wireline operable, sometimes called sliding sleeves or sliding side doors, or they could be remotely operated valves that depend on a series of hydraulic or electric, or both control lines, typically called interval control valves (ICVs).

Regardless of completion type, what is found is that: the overall production rate and remainder obtained after production are universally less than what it was predicted to be taking into account of the reservoir properties demonstrated in each individual zone during the flowbacks testing following fracture of the wellbore.

Some of the reduced performance can be attributed to cross flow between zones and other interference phenomena. However, the reduced performance is typically of such magnitude that all of the reduction cannot be attributable to cross flow.

In various situations, a more significant cause of production impairment is damage to the formation that takes place during the milling of the plugs. While the use of composite versus cast iron bridge plugs has significantly reduced the time and expense required for milling, the process invariably requires circulation of fluids and managing the well bore pressures in a way that results in contamination of various production zones of the reservoir with well bore fluids, such that the effective permeability of the zones is reduced. This is often thought of as slate damage. In essence, the process of removing the plugs can reverse much of the productivity improvements provided by the initial fracture stimulation.

Multiple valve assemblies may be used in coordination with multiple zones of production. In one embodiment, an individual zone of production can be completed and isolated before working on another zone. Criteria utilized for determining the sequence of production may include formation pressures, production rates, and recovery from each zone as disclosed in U.S. Pat. No. 6,808,020.

Once a zone has been completed, completion fluids within the wellbore can leak off into the formation in a process commonly known as "fluid loss". The wellbore may fill with formation fluids as a result of the reduction of hydrostatic pressure on the completed zone. A blow-out may occur if fluid loss occurs during completion activities. Fluid may be added to the wellbore to maintain hydrostatic pressure, as disclosed in U.S. Pat. No. 6,808,020.

The purpose of cementing the casing is to provide a seal between zones since the drilling of the hole breaks through the natural barriers. Perforations (from sharper changes) provide communication through casing and cement to formation. In High Penn reservoirs, perforation alone is enough to put the well on production.

In Low Perm reservoirs (tight reservoirs), one creates additional exposure by creating fractures in the rock. That can extend far from the well bore. Typically, the fracture (or frac) fluid contains proppant solids designed to hold the fractures open (propped open) so that production fluids flow easily through the fracture back into the well bore.

In instances where fracturing is not necessary, perforation quality is critical because the perforation needs to cut through the casing, the cement, and extend into the formation enough to pass any formation damage that occurs during drilling the well.

Commonly, in various embodiments, all that is needed to fracture stimulate is the perforation job to provide communication from the wellbore to the reservoir. Once the fracture is initiated, the Frac job will typically cause the area around the plugged hole in the casing to be removed. In various further embodiments, perforation through only the casing is sufficient to allow the facture pressures to cause the cement to fail in the area about the casing perforation hole and thereby allow communication. However, in various embodiments, the fracture pressure will not be sufficient to break the cement.

Systems and processes for removing fluids from a wellbore are known in the art. Various examples of prior art systems and processes include U.S. Pat. Nos. 7,426,938; 7,114,558; 7,059,407; 6,957,701; 6,808,020; 6,732,803; 6,631,772; 6,575,247; 6,520,255; 6,065,536; 5,673,658; 4,852,391; 4,559,786; 4,557,325; 2,067,408; 2,925,775; 2,968,243; 2,986,214; 3,028,914; 3,111,988; 3,118,501; 3,366,188; 3,427,652; 3,429,384; 3,547,198; 3,662,833; 3,712,379; 3,739,723; 3,874,461; 4,102,401; 4,113,314; 4,137,182; 4,139,060; 4,244,425; 4,415,035; 4,637,468; 4,671,352; 4,702,316; 4,776,393; 4,809,781; 4,860,831; 4,865,131; 4,867,241; 5,025,861; 5,103,912; 5,131,472; 5,161,618; 5,309,995; 5,314,019; 5,353,875; 5,390,741; 5,485,882; 5,513,703; 5,579,844; 5,598,891; 5,669,448; 5,704,426; 5,755,286; 5,803,178; 5,812,068; 5,832,998; 5,845,712; 5,865,252; 5,890,536; 5,921,318; 5,934,377; 5,947,200; 5,954,133; 5,990,051; 5,996,687; 6,003,607; 6,012,525; 6,053,248; 6,098,713; 6,116,343; 6,131,662; 6,186,227; 6,186,230; 6,186,236; 6,189,621; 6,241,013; 6,257,332; 6,257,338; 6,272,434; 6,286,598; 6,296,066; 6,394,184; 6,408,942; 6,446,727; 6,474,419; 6,488,082; 6,494,260; 6,497,284; 6,497,290; 6,543,538; 6,543,540; 6,547,011, the contents all of which are hereby incorporated by reference as if reproduced in its entirety.

SUMMARY OF THE INVENTION

In general, various embodiments of the present invention relate to apparatuses, systems and processes for isolating at least one production zone in a wellbore.

The present invention provides a method, system, and apparatus for perforating and stimulating multiple formation intervals, which allows each single zone to be treated with an individual treatment stage while eliminating or minimizing the problems that are associated with existing coiled tubing or jointed tubing stimulation methods and hence providing significant economic and technical benefit over existing methods.

Various embodiments of the present invention comprise a fracture valve tool comprising a mandrel defining a through passage, wherein said mandrel comprises at least a first mandrel port extending from an exterior surface of said mandrel to an interior surface of said mandrel; and wherein there is a rotating sleeve rotatably positioned on said mandrel, said rotating sleeve comprising at least one sleeve port, wherein said rotating sleeve rotates between at least a first position wherein said at least one sleeve port does not align with said at least one mandrel port and a second position wherein said at least one sleeve port is at least partially aligned with said at least one mandrel port whereby communication from said exterior surface of said mandrel to said interior surface of said mandrel is possible. In a further embodiment, the fracture valve tool further comprises cement flow paths at various locations around the circumference of the fracture valve tool.

An embodiment of the present invention is a fracture valve tool for running with a production string comprising at least one production tubing, said fracture valve tool comprising a mandrel defining a through passage smaller than that of said production tubing; a blapper valve; and a valve actuator, wherein said valve actuator is can be actuated into at least a first position wherein said rotary valve is open and said through passage is open and at least a second position wherein said blapper valve is closed and said through passage is closed. In a further embodiment, the fracture valve tool further comprises cement flow paths at various locations around the circumference of the fracture valve tool. In yet another embodiment, the fracture valve tool further comprises at least one packer assembly comprising at least one packer and a mandrel. In an embodiment of the present invention, the at least one packer assembly is positioned above said blapper valve. In another embodiment, the at least one packer assembly is positioned about a hydrocarbon producing zone. In an embodiment of the present invention, the wellbore exterior to the fracture valve tool is not cemented. In another embodiment, the fracture valve tool further comprises a battery pack operably connected to said valve actuator. In another embodiment, the fracture valve tool further comprises a piston operably connected to said valve actuator for rotating said blapper valve between said open position and said closed position. In yet another embodiment, the fracture valve tool further comprises a control wire running downhole to the actuator for controlling the actuator.

An embodiment of the present invention is a completed wellbore with at least a first production zone, said completed wellbore further comprising a casing string and at least one fracture valve tool connected to a production string and positioned below said first production zone. In another embodiment, the completed wellbore further comprises a second production zone and a second fracture valve tool connected to a production string and positioned below said second production zone. Another embodiment of the present invention is a process for producing a hydrocarbon from the completed wellbore comprising the steps of: opening said fracture valve tool; fracturing said production zone; flowing a drilling mud; and producing hydrocarbon up the production string.

Another embodiment of the present invention is a production string comprising a fracture valve tool for running with a production string comprising at least one production tubing, said fracture valve tool comprising a mandrel defining a through passage smaller than that of said production tubing; a rotary valve; and a valve actuator; wherein said mandrel comprises at least a first mandrel port extending from an exterior surface of said mandrel to an interior surface of said mandrel; and wherein there is a rotating sleeve rotatably positioned on said mandrel, said rotating sleeve comprising at least one sleeve port, wherein said rotating ported sleeve rotates between at least a first position wherein said at least one sleeve port does not align with the at least one mandrel port and a second position wherein said at least one sleeve port is at least partially aligned with said at least one mandrel port whereby communication from said exterior surface of said mandrel to said interior surface of said mandrel is possible.

Yet another embodiment of the present invention is a casing string comprising a fracture valve tool comprising a mandrel comprising at least a first open end and a second open end; wherein said mandrel comprises at least a first mandrel port extending from an exterior surface of said mandrel to an interior surface of said mandrel; and wherein there is a rotating sleeve rotatably positioned on said mandrel, said rotating sleeve comprising at least one sleeve port, wherein said rotating sleeve rotates between at least a first position wherein said at least one sleeve port does not align with said at least one mandrel port and a second position wherein said at least one sleeve port is at least partially aligned with said at least one mandrel port whereby communication from said exterior surface of said mandrel to said interior surface of said mandrel is possible. In a further embodiment, the mandrel is connected to one of a casing string or a production string. In another embodiment, the fracture valve tool is in a wellbore. In yet another embodiment, the fracture valve tool is in a closed position. In yet another embodiment, the fracture valve tool is in an open position. In an embodiment of the present invention, the fracture valve tool is above or below an oil and gas formation. In another embodiment of the present invention, the fracture valve tool is both above and below an oil and gas formation. In an embodiment of the present invention, the casing string further comprises at least one packer. An embodiment of the present invention is a completed wellbore comprising the casing string.

An embodiment of the present invention is a method of isolating production zones comprising connecting at least one fracture valve tool to the production string; and positioning the at least one fracture valve tool below a first production zone, wherein the at least one fracture valve tool is in a closed position. In another embodiment, the method comprises connecting a second fracture valve tool to the production string and positioned below a second production zone, wherein the second fracture valve tool is in a closed position.

Another embodiment of the present invention is a method of completing a wellbore comprising assembling a production string comprising a fracture valve tool for running with a production string comprising at least one production tubing, said fracture valve tool comprising a mandrel, wherein said mandrel defines a through passage smaller than that of said production tubing and comprises at least a first mandrel port extending from an exterior surface of said mandrel to an interior surface of said mandrel; rotating a rotating sleeve positioned on said mandrel, said rotating sleeve comprising at least one sleeve port; wherein said rotating sleeve rotates so that at least one sleeve port is at least partially aligned with said at least one mandrel port whereby communication from said exterior surface of said mandrel to said interior surface of said mandrel is possible; fracturing production zone; flowing a drilling mud; and producing hydrocarbon up the production string.

Certain embodiments of the invention describe a mandrel defining a through passage smaller than that an exterior portion of the mandrel comprising a rotary valve operatively connected to the through passage and a valve actuator, wherein said valve actuator is can be actuated into at least a first position wherein said rotary valve is open and said through passage is open and at least a second position wherein said rotary valve is closed and said through passage is closed.

In more specific embodiments, the actuator may comprise a battery pack operably connected to the valve actuator. In other embodiments, the rotary valve comprises a piston, wires or a shaft operably connected to a valve actuator for rotating the rotary valve between open and closed positions.

Still further, the invention contemplates that the actuator may have a control wire running downhole to the actuator for controlling the actuator.

Various further embodiments comprise a measurement line extending from the mandrel for taking data measurements downhole at about the production zone. Examples of measurements that might be taken include but are not limited to density, temperature, pressure, pH, and/or the like. Such measurements can be used to help run the well. In various embodiments, a cable would communicate the data to an operator at the surface. In various further embodiments, the data is transmitted remotely to an operator. In further embodiments, the data is stored.

Such a valve arrangement as herein disclosed would relieve stress to the formation, as no stressful perforation would be required in various embodiments. As well, cementing of the well would be impeded by cavities or rough portions on typical completions. In various embodiments, the mandrel interior surface is fairly smooth and would allow the passage of a cement wiper plug.

Various methods of actuating the valve actuator are possible. In an embodiment a battery pack is operably connected to the valve actuator. The battery pack can be used to supply power to all manner of actuation devices and motors, such as a pneumatic motor, a reciprocating motor, a piston motor, and/or the like. In various further embodiments, the actuator is controlled by a control line from the surface. The control line can supply power to the actuator, supply a hydraulic fluid, supply light, fiber optics, and/or the like. In an embodiment, there are three control lines running to the actuator, such that one opens the actuator, one closes the actuator, and one breaks any cement that is capable of fouling the actuator and preventing it from opening. The cement on the actuator may be broken by any method common in the art such as vibration, an explosive charge, a hydraulic force, a movement up or down of the valve, and/or the like. Generally, any necessary structures for performing the vibrations, charges, movements, and/or the like can be housed in the mandrel about the valve.

In various embodiments, a piston is operably connected to the valve actuator for rotating the rotary valve between the open position and the closed position.

Various embodiments of the present invention comprise a completed wellbore with at least a first production zone, the completed wellbore further comprising a cemented casing string, a production string, and at least one fracture valve tool as herein disclosed connected to the production string and positioned below the first production zone, wherein the at least one fracture valve tool is cemented in a closed position. Further embodiments comprise a second production zone and a second fracture valve tool as herein disclosed connected to the production string and positioned below the second production zone, wherein the second fracture valve tool is cemented in a closed position.

Further embodiments disclose a process for producing a hydrocarbon from a completed wellbore, the process comprising the steps of opening a rotary valve; fracturing a production zone; flowing a drilling mud through the completed wellbore for clean up; and, closing the rotary valve, wherein a hydrocarbon is produced up the production string.

In further embodiments, the invention discloses repeating the steps of: opening a second rotary valve; fracturing a second production zone; flowing a drilling mud through the completed wellbore for clean up; and closing the second rotary valve, wherein a hydrocarbon is produced up the production string.

Various further embodiments of the present invention disclose a casing string section for a hydrocarbon production well, the casing section comprising: a mandrel comprising at least a first mandrel port extending from an exterior surface of the mandrel to an interior surface of the mandrel; and, a rotating sleeve rotatably positioned on the mandrel, the rotating sleeve comprising at least one sleeve port, wherein the rotating ported sleeve rotates between at least a first position wherein the at least one sleeve port covers the at least one mandrel port and a second position wherein the at least one sleeve port is at least partially aligned with the at least one mandrel port whereby communication from the exterior surface of the mandrel to the interior surface of the mandrel is possible. In various embodiments there is a control line associated with the mandrel.

Further embodiments disclose a cement flowpath passing through the mandrel. In an embodiment, the rotatable sleeve is a ball valve or is on a ball valve.

In various embodiments, this system can be run without a production string and still selectively isolate the production zones in the wellbore. In various embodiments, as a casing string is run, the sliding sleeves are aligned about the production zones. The sliding sleeves are maintained in a closed position. When the last piece of casing is run and the casing string set, by packer or not, cement can be added as normal into the casing string. At each casing string section, a packer or other device will divert the cement into the cement flowpath for filling. The annulus of the wellbore can likewise be filled as normal.

Various embodiments comprise a completed wellbore for producing at least one hydrocarbon without the need for perforation comprising a casing string comprising at least one casing string section as herein disclosed positioned about a hydrocarbon production zone, wherein a cement is flowed into a cement flowpath in the casing string section and back up the exterior of the casing string section in the wellbore. In various embodiments, there is at least one casing string section as herein disclosed per hydrocarbon production zone.

When production is desired, one or more of the rotary valves can be actuated such that communication is capable from the exterior of the mandrel to the interior of the mandrel. Typically, a fracture is required to allow production and clear any cement that has migrated into the zone. After the fracture, the zone is cleaned by flowing a drilling mud and production can begin. If production needs to be stopped, the rotary valve can be actuated again and the valve closed.

In various embodiments of the present invention, the fracture valve tool may be used with various types of valves including rotary valves, blapper valves, J valves, fill-up valves, circulating valves, sampler valves, pilot valves, solenoid valves, safety valves, and/or the like.

Embodiments of the present invention also include an actuator module and the use of such an actuator module for actuating a downhole tool within a wellbore. In certain embodiments, the actuator may include a housing comprising a chamber and piston disposed within the chamber, i.e. a piston chamber or a cylindrical chamber with a linkage member operatively connecting the housing to the piston.

Still further, the actuator module may comprise an incompressible fluid disposed within the chamber. For instance, in certain embodiments, an incompressible fluid may be disposed within the chamber on one side or a first side of the piston and a fluid path permitting hydrostatic pressure of the wellbore may be applied to the second side of the piston. In addition to the fluid path permitting hydrostatic pressure of the wellbore being applied to the second side of the piston, the fluid path may be also be applied to at least one surface of the linkage member of the actuator module whereby the pressure of the incompressible fluid increases in response to an increase in the hydrostatic pressure of the wellbore.

In further embodiments, the housing of the actuator module may include or comprise a shoulder for contacting the second side of the piston to limit axial displacement of the piston and the linkage member.

Additionally, the actuator module may comprise a gas chamber at least partially filled with a compressible gas, an isolation module comprising a pressure barrier between the piston chamber and the gas chamber.

Still further, the actuator module of the present invention may include a controller comprising a microprocessor for running a real time program that causes the controller to generate an electrical output signal in response to at least one conditional event and an electrical power source for powering the controller.

Additionally, the actuator module may comprise an opening module for breaching the pressure barrier between the piston chamber and the gas chamber in response to the electrical output signal generated by the controller in order to cause actuation of the downhole tool.

In further embodiments, the actuator module may comprise at least one sensor interface with the controller for measuring a parameter, such as an environmental parameter, wherein the controller generates an electrical output signal in response to at least one conditional event and wherein the conditional event is a function of at least one output from the sensor or sensors.

In additional embodiments wherein an actuator module is contemplated, the isolation module of the actuator module may comprise a pressure retaining target section for retaining differential pressure generated between the piston or cylindrical chamber and the gas chamber. Still further, the isolation module may comprise a valve seat for providing engagement with the opening module which is designed to breach the pressure barrier between the cylindrical or piston chamber and the gas chamber.

In certain embodiments, the opening module further comprises a valve and a valve seal for engaging the valve seat of the isolation module. In other embodiments, the opening module is an electrically activated disc cutter comprising a cutting dart for perforating the pressure barrier.

The actuator module may further comprise a controller comprising a microprocessor for running a real time program that causes the controller to generate an electrical output signal in response to at least one conditional event which may include a communication receiver for receiving communication signals from a remote location. It is further contemplated that the conditional event is a function of the communication signal. The controller comprising a microprocessor for running a real time program that causes the controller to generate an electrical output signal in response to at least one conditional event may further include a communication transceiver for transmitting communication signals to a remote location wherein the transmitted communication signal is an indication of the occurrence of the conditional event.

Other embodiments of the inventions described herein pertain to methods of using an actuator module. In certain embodiments, a method for actuating a downhole tool within a wellbore includes operatively connecting one member (at least one or more) of the downhole tool to the actuator module, lowering the tool into the wellbore to a subterranean depth, sensing a conditional event or events with the controller, generating an electrical output signal with the controller in response to the conditional event or events sensed by the controller and breaching the pressure barrier between the cylindrical chamber and the gas chamber with the opening module in response to the electrical output signal generated by the controller, thereby causing actuation of the downhole tool.

In still further embodiments of methods pertaining to the use of an actuator module, the actuator module may operatively connect a member of the downhole tool to a surface of the piston.

Other embodiments of the methods pertaining to the use of an actuator module contemplate lowering the downhole tool into the wellbore to a subterranean depth wherein one surface of the piston that is not operatively connected to a member of the downhole tool is instead exposed to the hydrostatic pressure of the wellbore.

Additional embodiments of the methods pertaining to the use of an actuator module related to the controller. For instance, in certain embodiments, the methods relate to programming the controller's microprocessor with a timing countdown, starting the timing countdown and generating the controller electrical output signal with the controller in response to the expiration of the timing countdown.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

Figure 1:
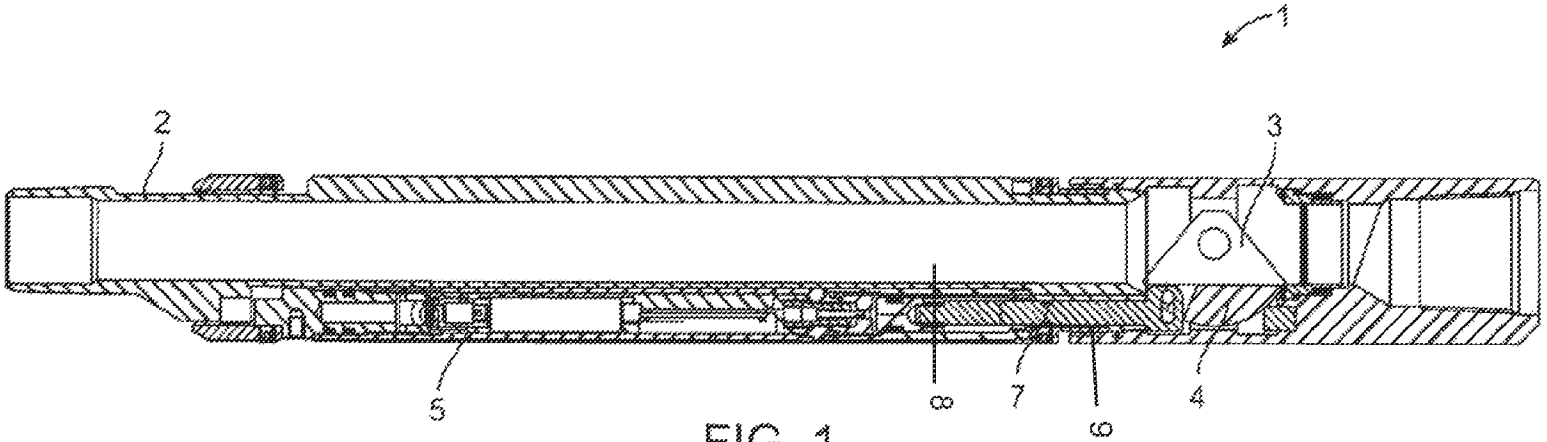
FIG. 1 is an illustration of a cross section of an embodiment of the present invention with an embodiment of a mandrel with a rotary valve.

LIST OF REFERENCE NUMERALS mandrel with rotary valve 1
mandrel 2
rotary valve 3
valve tip 4
valve actuator 5
piston 7
fracture valve tool 100
cement flowpaths 105 and 109
longitudinally extending borehole 107
fracture valve tool mandrel 110
sleeve port 120 and 123
rotating sleeve 125
mandrel port 127
casing 130
spacer 131
cement flowpaths 132
exterior surface of the mandrel 140
control line 145
interior surface of the mandrel 150
casing string section 200
casing string section valve actuator 210 casing string section (with a rotatable sleeve in a longer casing section) 300
port 310
connection of another casing section 320
well completion 400
multiple fracture valve tools 410
packers 415
bottom sub or packer 417
ports 419
multiple production zones 420
cemented section 430
well completion 500
casing string section 510
rotary sleeve 515
packed section 517
production zones 520
cemented section 530
bulkhead 622
shoulder 623
o-ring 700
second o-ring 701
wire set 800
second wire set 801
linear grove 810
integral thin target section 820
isolation module with a disk welded 830
diverging radii 840
hole 850
spring 900
opening module 901
bimetallic fuse wire 902
solid ring 903
solenoid sleeve 904
heating element 910
insulated potting material 911.
stainless steel metal tube 1000
insulation layer 1001
conductor cable 1002
jam nut 1003
metal ferrule seals 1004
cable assembly wire 1005
I-wire cable assembly 1006
wellbore fluid 1007
interior of the tool 1008
bulkhead insulator 1009
tool end cap 1010
I-Wire cable assembly PCBA 1011
I-Wire cable assembly device body 1012
valve seat 1100
extended valve stem 1101
solenoid valve based opening module 1102
isolation module 1106
fluid communication path 1107

DETAILED DESCRIPTION OF THE ILLUSTRATIVE EMBODIMENTS

In the following description, certain details are set forth such as specific quantities, sizes, etc. so as to provide a thorough understanding of the present embodiments disclosed herein. However, it will be obvious to those skilled in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

The present invention will be described in connection with its preferred embodiments. However, to the extent that the following description is specific to a particular embodiment or a particular use of the invention, this is intended to be illustrative only, and is not to be construed as limiting the scope of the invention. On the contrary, the description is intended to cover all alternatives, modifications, and equivalents that are included within the spirit and scope of the invention, as defined by the appended claims.

A. Terminology

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The following definitions and explanations are meant and intended to be controlling in any future construction unless clearly and unambiguously modified in the following Description or when application of the meaning renders any construction meaningless or essentially meaningless. In cases where the construction of the term would render it meaningless or essentially meaningless, the definition should be taken from Webster's Dictionary, 3rd Edition. Definitions and/or interpretations should not be incorporated from other patent applications, patents, or publications, related or not, unless specifically stated in this specification or if the incorporation is necessary for maintaining validity.

As used herein, the term "downhole" means and refers to a location within a borehole and/or a wellbore. The borehole and/or wellbore can be vertical, horizontal or any angle in between.

As used herein, the term "fracturing," "frac" or "Frac" is a well stimulation process performed to improve production from geological formations where natural flow is restricted. Typically, fluid is pumped into a well at sufficiently high pressure to fracture the formation. A proppant (sand or ceramic material) is then added to the fluid and injected into the fracture to prop it open, thereby permitting the hydrocarbons to flow more freely into the wellbore. Once the sand has been placed into the fracture, the fluid flows out of the well leaving the sand in place. This creates a very conductive pipeline into the formation. Normal fracturing operations require that the fluid be viscosified to help create the fracture in the reservoir and to carry the proppant into this fracture. After placing the proppant, the viscous fluid is then required to "break" back to its native state with very little viscosity so it can flow back out of the well, leaving the proppant in place.

As used herein, the term "borehole" means and refers to a hole drilled into a formation.

As used herein, the term "annulus" refers to any void space in an oil well between any piping, tubing or casing and the piping, tubing or casing immediately surrounding it. The presence of an annulus gives the ability to circulate fluid in the well, provided that excess drill cuttings have not accumulated in the annulus preventing fluid movement and possibly sticking the pipe in the borehole.

As used herein, the term "valve" means and refers to any valve, including, but not limited to flow regulating valves, temperature regulating valves, automatic process control valves, anti vacuum valves, blow down valves, bulkhead valves, free ball valves, fusible link or fire valves, hydraulic valves, jet dispersal valve, penstock, plate valves, radiator valves, rotary slide valve, rotary valve, solenoid valve, spectacle eye valve, thermostatic mixing valve, throttle valve, globe valve, combinations of the aforesaid, and/or the like.

As used herein, "perforate" means and refers to providing communication from the wellbore to the reservoir. Perforations (or holes) may be placed to penetrate through the casing and the cement sheath surrounding the casing to allow hydrocarbon flow into the wellbore and, if necessary, to allow treatment fluids to flow from the wellbore into the formation.

As used herein, "mandrel" means and refers to a cylindrical bar, spindle, or shaft around which other parts are arranged or attached or that fits inside a cylinder or tube.

As used herein, "packer", means and refers to a piece of equipment that comprises of a sealing device, a holding or setting device, and an inside passage for fluids. In one embodiment it is a plug that is used to isolate sections of a well or borehole.

B. Fracture Valve and Fracture Valve Tool

Embodiments of the present invention may be used in any wellbore, including multi-zone completions where it is required to perform fracture stimulation on separate zones of the formation, and/or the like.

The present invention provides a method, system, and apparatus for perforating and/or fracturing multiple formation intervals, which allows each single zone to be treated with an individual treatment stage while minimizing the problems that are associated with existing coiled tubing or jointed tubing stimulation methods and hence providing significant economic and technical benefit over existing methods.

Typically in wellbore completion, a packer type element, such as a packer made of cement is used to isolate different production zones from one another during the extraction process. In many instances, such packing is done to better extract hydrocarbons from a production zone where pressure, temperature pH and geologic formation may make extraction from each area at once inefficient. Inefficiency may result in the expenditure of excess chemicals, lubricants, components and the like or may be in the form of lowered hydrocarbon production or may be in the cost if increased rig time.

Typically in a wellbore construction, once the original wellbore is drilled, casing is added and cement pumped through the interior of the casing out the bottom, where it flows back up between the casing and the wellbore. The internal area of the casing is then cleaned typically with a mechanical scrubbing mechanism.

Once cleaning of the interior of the casing has been accomplished the production zone of interest will be perforated. One such method is using a mandrel with a fracture valve tool running with a production string. The fracture valve tool may comprise a mandrel defining a through passage smaller than that of the production tubing.

An embodiment of the present invention is a system for completing multi-zone fracture stimulated wells that provides for cementing the casing in place except adjacent to a tubing mounted rotary valve which has the capability of tolerating fracture stimulation treatments through the valve. In various embodiments, perforation can be eliminated and the treated zone can be protected while other zones are treated. In various embodiments, the system may be configured to allow all zones to be opened on a single command or may be configured for selective zonal control once the well is put on production.

In certain embodiments, the mandrel may be operatively connected to a perforated casing. In such instances, the casing and the mandrel comprising or consisting of a fracture valve tool may have perforations. Likewise, the casing where it is contemplated to place the mandrel with the fracture valve tool may also have perforations, such that when the perforations from the casing and the mandrel are not aligned, pumpable cement, upon exiting the bottom of casing, is unable to reenter the interior of the casing through the perforations.

In other embodiments, the mandrel may not be operatively connected to a perforated casing, but rather adjacent to the area with the perforated casing such that the space between the mandril and the casing is minimal. In certain embodiments, it is contemplated that the spacing prevents most or all of the pumpable cement used during completion of the casing cementing process does not reenter the interior of the casing.

In either embodiment, the perforations may not be aligned with the perforations of the mandrel containing the fracture valve tool during the cementing process. Once the wellbore operator is ready to fracture a production zone, the mandrel containing the fracture valve tool may be aligned with the perforated casing. This alignment allows high pressure such as in the form of a controlled explosion or gas or fluid injection to follow a path of least resistance and penetrate the cement and enter the production zone.

In embodiments wherein a mandrel comprising or consisting of a fracture valve tool, either operatively connected to the perforated casing or adjacent to the perforated casing is used in fracturing the production zone to extract hydrocarbons, it is contemplated that shrapnel or debris in the form of metal from the casing will not enter the production zone. Thus the only debris from the fracturing of the production zone will be in the form of cement debris and geological debris from the production zone. Accordingly, a lack of metal debris may result in either or both a higher flow of hydrocarbons from the production zone and a decreased cleanup time.

In addition to fracturing a production zone, a typical zone will be isolated via the use of a cement, metal or composite plug or packing device as discussed above. However, to extract hydrocarbons from below the plug or packing device, it will often be necessary to remove the plug or packing device through an extraction means, drill through the plug or packing device resulting in increased rig time and debris removal, or destroy the plug or packing device such as through the use of a piston.

Methods of isolating zones previously included the use of a plug. The plug may be comprised of cement, metal, or a composite material. In such situations, it is necessary to drill through the plug to reach the zones isolated below the plug. This requires additional rig time. An advantage of embodiments of the present invention is decreased rig time in comparison to when plugs need to be drilled.

The fracturing process is a method of stimulating production by opening channels in the formation. Fluid, under high hydraulic pressure is pumped into the production tubing. The fluid is forced out of the production tubing below or between two packers. Examples of fracturing fluids are distillate, diesel, crude, kerosene, water, or acid. Proppant material may be included in the fluid. Examples of propping agents are sand and aluminum pellets. The pressure causes the fluid to penetrate and open cracks in the formation. When the pressure is released, the fluid goes back to the well but the proppant material stays in the cracks.

Figure 3:
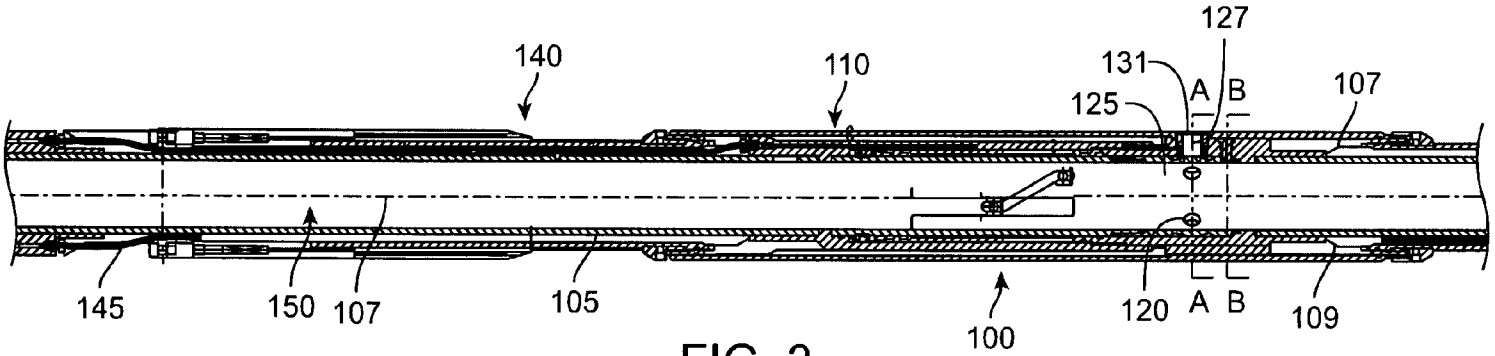
FIG. 3 is an illustration of an alternate embodiment of the present invention with an embodiment of a fracture valve tool.

Referring to FIG. 3, an embodiment of a fracture valve tool 100 comprising a mandrel 110, a mandrel port 127, an interior surface of the mandrel 150, and exterior surface of the mandrel 140, a rotating sleeve 125, a sleeve port 120, spacer 131, a control line 145, and cement flowpaths 105 and 109 is illustrated. Further, a casing string section defines a longitudinally extending borehole 107, through which cement also flows.

Figure 4B:
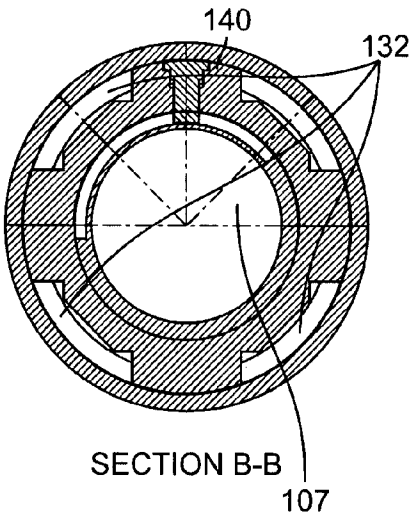
FIG. 4*b* is an illustration of a cross section B-B of FIG. 3.
Figure 4A:
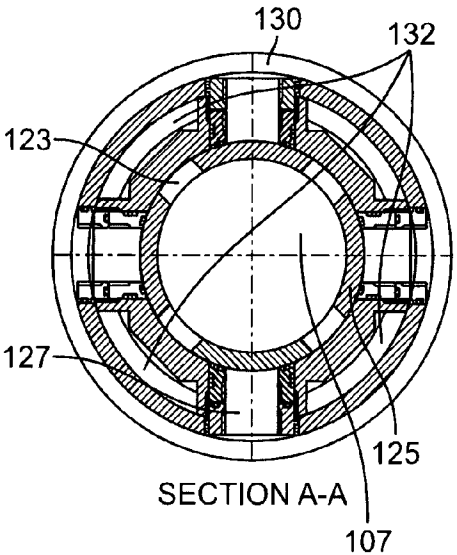
FIG. 4*a* is an illustration of a cross section A-A of FIG. 3.

Referring to FIG. 4*a*, a cross sectional cut along A-A is illustrated. Rotating sleeve 125 is illustrated in a closed position whereby the interior of the casing string section cannot communicate with the exterior of the casing string. Upon actuation of the fracture valve, sleeve port 123 is capable of at least partially aligning with mandrel port 127. Upon at least partial alignment of the sleeve port 123 and mandrel port 127, the exterior and interior of the casing string are in communication. Spacer 131 from FIG. 3 can be fractured out when production from the formation is desired. The exterior of the casing string section 100 comprises casing 130. In one embodiment, the fracture valve tool of the present invention may be used in combination with the rotary valve 3 disclosed in the related application titled Processes and Systems for Isolating Production Zones in a Wellbore, filed the same day as the present application. In various embodiments, upon actuation of the rotary valve 3, sleeve port 123 is capable of at least partially aligning with mandrel port 127. Upon at least partial alignment of the sleeve port 123 and mandrel port 127, the exterior and interior of the casing string are in communication.

In typical embodiments, the at least one mandrel with rotary valve 1 is in a closed position when being cemented in the zones of interest. Optionally the cement has been weakened in the area of the valve parts. In a zone of interest, the fracture valve tool is opened wherein the sleeve port 123 is at least partially aligned with mandrel port 127 and the formation is fractured. Advantages of the present invention include, but are not limited to, that formation is not damaged by metal during the fracture and rig time is saved because it is not necessary to use plugs and drill the plugs out when it is time for production. Damage to the formation following fracture can decrease production as can the process of removing the plugs.

Referring to FIG. 4*b*, a sectional cut along B-B in FIG. 3 is illustrated. Cement flowpaths 132 are illustrated as not interfering with the interior of the mandrel of any of the ports.

Figure 5:
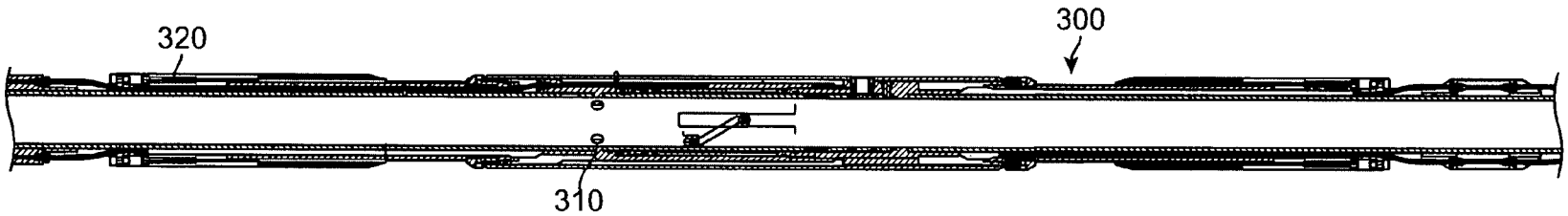
FIG. 5 is an illustration of an alternate embodiment of the present invention with an embodiment of a casing string section.
Figure 6:
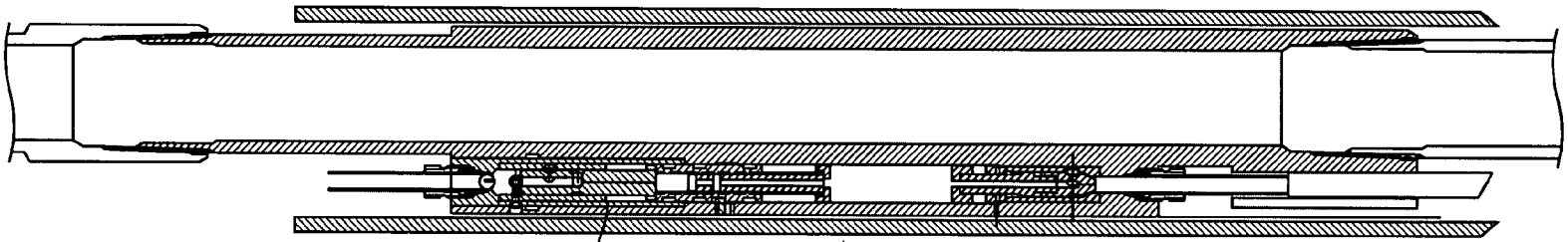
FIG. 6 is an illustration of an alternate embodiment of the present invention with an embodiment of an actuation device.

Referring to FIG. 5, a casing string section 300 with a rotatable sleeve in a longer casing section is illustrated. Port 310 for communication is visible. A connection of another casing section is illustrated at connection 320.

Various embodiments comprise a fracture valve tool 100 for running with a production string comprising at least one production tubing, the fracture valve tool 100 comprising a mandrel 110 defining a through passage smaller than that of the production tubing, a rotary valve 3 and a valve actuator 5. In various embodiments, the valve actuator 5 can be actuated into at least a first position wherein the rotary valve 3 is open and the through passage is open and at least a second position wherein the rotary valve 3 is closed and the through passage is closed. Various further embodiments comprise at least one packer assembly comprising at least one packer 415 and a mandrel 2. In various embodiments, the at least one packer assembly is positioned above the rotary valve 3. In various further embodiments, the at least one packer assembly is positioned about a hydrocarbon producing zone. Typically, the zone communicates with the packer assembly's mandrel 2.

A fracture valve tool comprises a mandrel 110. The mandrel 110 has a first mandrel port 127 that extends from the exterior surface 140 of the mandrel to the interior surface 150 of the mandrel. There is a rotating sleeve 125 against the interior surface of the mandrel. The rotating sleeve 125 is rotatably positioned on said mandrel 110, and comprises at least one sleeve port 123. The rotating sleeve 125, containing at least one sleeve port 123, rotates between a first position where the sleeve port 123 covers the mandrel port 127 and a second position where the sleeve port 123 is at least partially aligned with the mandrel port 127, allowing communication from the exterior of the mandrel 140 to the interior surface of the mandrel 150. In one embodiment, the rotating sleeve 125 is a ball valve or is on a ball valve.

A ball valve is a valve with a sphere with a hole through the middle. When the hole is in line with the tube or pipe, flow occurs. When it is turned a quarter turn, the hole is perpendicular to the tube or pipe, flow is blocked.

The exterior of the mandrel port 127 is near the outside of the casing formation and the interior is adjacent the rotating sleeve 125. When the fracturing occurs, damage to the formation is lessened because no metal from the casing string is blasted into the formation.

In various embodiments, in a completed wellbore, the mandrel with a rotary valve 1 is cemented in a closed position.

In one embodiment, there is at least one casing string comprising a fracture valve tool comprising a rotating sleeve 125 positioned on a mandrel 110. The mandrel 110 comprises at least one mandrel port 127 and the rotating sleeve 125 comprises at least one sleeve port 123 per zone of production. The ports on the mandrel 110 and a sleeve may be aligned by rotating the sleeve in a circumferential manner. In another embodiment, the ports on the mandrel 110 and a sleeve may be aligned by sliding the sleeve in vertical manner.

In various embodiments, the rotating sleeve 125 of the fracture valve tool may be rotated via an actuator or other suitable mechanism. The signal to rotate the rotating sleeve 125 may be delivered by the control line 145. In another embodiment, the signal may be transmitted remotely. In one embodiment, the fracture valve tool 100 may be acted upon by actuator 5. In other embodiments, the fracture valve tool 100 may be actuated electrically, pneumatically, hydraulically, thermally, hydrostatically, or a combination thereof. The actuator may create linear motion, rotary motion, or oscillatory motion. In certain embodiments, the rotating sleeve and/or rotary valve may be actuated based upon a signal transmitted from a downhole or surface source. Power sources include batteries present in the casing string section or lines containing hydraulic fluid or electricity. Multiple actuation systems may be used in a given fracture valve tool.

In one embodiment, the formation is optionally perforated prior to fracturing. Perforation provides communication to the reservoir. Once the fracture is initiated, the fracturing will cause the area around the hole in the fracture valve to be blown away. Perforating devices that may be used include, but are not limited to, a select-fire perforating gun system (using shaped-charge perforating charges) or a bar with fixed encapsulated hollow charges oriented in a single direction. Fracture pressures may be sufficient to cause the cement to fail in the area of the perforation hole.

In various embodiments, such a valve arrangement as herein disclosed would relieve stress to the formation, as no stressful perforation would be required in various embodiments. As well, cementing of the well would be impeded by cavities or rough portions on typical completions. In various embodiments, the mandrel interior surface is fairly smooth and would allow the passage of a cement wiper plug.

Various further embodiments comprise a measurement line extending from the mandrel for taking data measurements downhole at about the production zone. Examples of measurements that might be taken include but are not limited to density, temperature, pressure, pH, and/or the like. Such measurements can be used to help run the well. In various embodiments, a cable would communicate the data to an operator at the surface. In various further embodiments, the data is transmitted remotely to an operator. In further embodiments, the data is stored.

Various deployment means for use in an embodiment of the present invention were disclosed in U.S. Pat. No. 7,059,407 and include coiled tubing, jointed tubing, electric line, wireline, tractor system, etc. In one embodiment the assembly may be actuated based upon a signal from the surface. Suitable signal means for actuation from the surface, also disclosed in U.S. Pat. No. 7,059,407, include but are not limited to, electronic signals transmitted via wireline; hydraulic signals transmitted via tubing, annulus, umbilicals; tension or compression loads; radio transmission; or fiber-optic transmission. An umbilical may be used for perforating devices that require hydraulic pressure for selective-firing. Umbilicals could also be used to operate a hydraulic motor for actuation of components.

Various embodiments of the present invention comprise a completed wellbore with at least a first production zone, the completed wellbore further comprising a cemented casing string, a production string, and at least one fracture valve tool 100 as herein disclosed connected to the production string and positioned below the first production zone. In further embodiments, the at least one fracture valve tool 100 is cemented in a closed position and/or open position. Further embodiments comprise a second production zone and a second fracture valve tool 100 as herein disclosed connected to the production string and positioned below the second production zone, wherein the second fracture valve tool 100 is cemented in a closed and/or open position.

Further embodiments disclose a process for producing a hydrocarbon from the completed wellbore the process comprising the steps of: opening a rotary valve 3; fracturing a first production zone; flowing a drilling mud through the completed wellbore for clean up; and closing the rotary valve 3, wherein a hydrocarbon is produced up the production string.

Further embodiments disclose repeating the steps of: opening a second rotary valve 3; fracturing a second production zone; flowing a drilling mud through the completed wellbore for clean up; and, closing the second rotary valve 3, wherein a hydrocarbon is produced up the production string.

Further embodiments disclose a process for producing a hydrocarbon from the completed wellbore the process comprising the steps of: opening a rotary valve 3 associated with a mandrel with a rotary valve 1 comprising a mandrel 2 defining a through passage smaller than that of the production tubing, a rotary valve 3 and a valve actuator 5; and fracturing a first production zone.

In preferred embodiments, the fracture valve tool 100 may be metal in design, the metal may be any metal or alloy known in the art that is sufficient to prevent the flow of hydrocarbons through the rotary valve when closed. In certain preferred embodiments, the metal is steel, iron or titanium. In preferred embodiments the metal is not reactive towards hydrocarbons. The rotary valve may be for example from 1 mm in thickness to several centimeters in thickness to account for any pressure from the hydrocarbon product. In alternative embodiments, the rotary valve may be composed of a plastic polymer, graphite, carbon nanotube, diamond, fiberglass, glass, a ceramic, concrete, or other mineral compounds.

Such a valve arrangement as herein disclosed would relieve stress to the formation, as no stressful perforation would be required in various embodiments. As well, cementing of the well would be impeded by cavities or rough portions on typical completions. In various embodiments, the mandrel interior surface is fairly smooth and would allow the passage of a cement wiper plug.

Advantages of the design of the valve, include but are not limited to: 1) The valve inner diameter is smooth and has no recesses. This allows the cement wiper plug to pass through the system and wipe the inner diameter clean. 2) A rotary valve rotates along the inner diameter and in the scaling mechanism. 3) The system incorporates open hole inflatable elements on both sides of the valve. Cement is circulated through a path in the tool between the inflatable elements which decreases outside of the valve. 4) Three control lines may be used, one for actuating the external casing packers, one line for opening valves, and one line for closing valves. In another embodiment, a method is provided for the selective operation of the individual valves for the purpose of opening the rotary valve 3, flowing through drilling mud, closing the rotary valve 3, and closing valves. In yet another embodiment, more lines would be provided for individual line selectivity after the completion phase. In another embodiment, an additional line in excess of the number of zones may be used for complete selectivity with one line being the common line connected to the open side of the control piston. This does not necessarily need to be done from the bottom up.

C. Rotary Valve

It is contemplated in certain embodiments of the invention that a rotary valve may be used. In such embodiments, a rotary valve may be operatively attached to the interior of a mandrel. Accordingly, in the embodiments of the invention, it is contemplated that a rotary valve mandrel, that is a rotary valve operatively attached to a mandrel, may be used for plugging or capping of a casing. The rotary valve mandrel may be above the production zone. In certain embodiments, the rotary valve mandrel may be used in addition to a mandrel with a fracture valve tool.

Referring to FIG. 1, a sectional view of an embodiment of the present invention comprising a mandrel with rotary valve 1, a mandrel 2, a rotary valve 3, a valve tip 4, a piston 7, a fluid bore 8 and a valve actuator 5 is illustrated. A rotary valve 3 is in an open position. A sectional view of an embodiment of the present invention comprising a mandrel with rotary valve 1, a mandrel 2, a rotary valve 3, a valve tip 4, a piston 7, a through passage 8 and a valve actuator 5. The through passage 8 is the bore through which extracted liquids or gasses flow or are pumped to the surface. The piston 7 is positioned within the piston chamber 9. The blapper valve is a combination ball valve and flapper valve located on top of a mandrel 2. However, any type of valve is capable of use. In various embodiments, the mandrel 2 is also attached to an actuator 5. In various embodiments, the rotary valve can be run with a production string, cemented in and open automatically by time or signal. In other embodiments, the rotary valve may not be cemented in. Typically, a rotary valve would be positioned above and below a formation with hydrocarbons. In other embodiments, the rotary valve is positioned above a formation with hydrocarbons. In various embodiments, the rotary valve can be run as casing for the wellbore and production can occur after the valve is opened.

Figure 2:
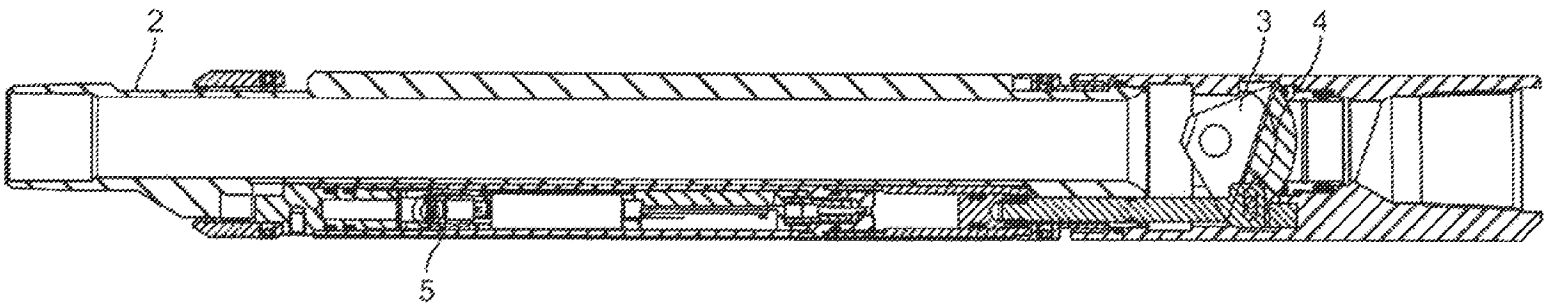
FIG. 2 is an illustration of the cross section of FIG. 1 in a different orientation.

Referring to FIG. 2, the mandrel with valve 1 of FIG. 1 in a closed position is illustrated.

When a mandrel with valve 1 is used in addition to a mandrel with a valve tool 100, it is contemplated that the mandrel with valve 1 may be above the mandrel with the fracture valve tool 100. In certain embodiments, the mandrel with a valve 1 sits atop the mandrel with the valve tool 100. In other embodiments, the mandrel with rotary valve 1 is attached to or is positioned atop casing allowing for a space between the mandrel with a rotary valve 1 and the mandrel with the valve tool 100. In such embodiments, the length of casing between each type of mandrel is about 1 cm to 100 m or more.

In certain embodiments, wherein the rotary valve 3 is within a mandrel, the rotary valve 3 may also operatively connected to a piston or wires or a shaft which may be operatively connected to an actuator. In certain embodiments, the actuator may be operatively connected internally to the rotary valve mandrel. In other embodiments, the actuator may be operatively connected externally to the mandrel with a rotary valve.

In embodiments of the invention wherein the rotary valve 3 is operatively connected to a piston or wires or a shaft, the piston or wires or shaft may move the rotary valve from a closed position wherein hydrocarbon flow is prevented to a partially open position wherein hydrocarbon flow is partially restricted to a fully open position wherein hydrocarbon flow is not restricted. In certain application the rotary valve 3 may be 100% closed or 100% open. In other applications, the rotary valve 3 may be 1%, 2%, 3%, 4%, 5%, 6%, 7%, 8%, 9% or 10% opened or closed or some percentage in between. In other applications the rotary valve 3 may be from 11% to 99% open or closed or some percentage between.

In embodiments of the invention wherein the rotary valve 3 is operatively connected to a piston or wires or a shaft, the piston or wires or shaft may be positioned above the rotary valve, below the rotary valve or adjacent to the rotary valve. The actuator for the piston or wires or shaft may also be positioned above, adjacent to or below the rotary valve. In certain embodiments, the actuator may be positioned above the rotary valve wherein the piston or wires or shaft may be positioned below the rotary valve. In such embodiments it may be necessary to reverse or re-orient the force of the piston or wires or shaft on the rotary valve through the use of a pulley or hinge, or joint type mechanism.

In embodiments wherein the rotary valve 3 is closed, the valve may be considered to have a cap or end above which no hydrocarbon product may pass. In certain embodiments, the cap may be flat, in other embodiments, the cap may be convex as viewed from above the mandrel. In other embodiments the cap may be concave as viewed from the top of the mandrel. In certain embodiments, wherein the cap is flat, the closure may look diagonal as viewed from the top of the mandrel. In such instances, the angle between the cap and the internal portion of the mandrel may be an obtuse angle or greater than 90° and an acute angle of less than 90°. In embodiments wherein the cap is flat, the closure may be horizontal or perpendicular to the axis of the mandrel. In such cases, the angle between the cap and the internal portion of the mandrel may be 90° as viewed from the top of the mandrel. In certain embodiments, wherein the cap is concave or convex, the closure may look diagonal as viewed from the top of the mandrel. In such instances, the angle between the concave or convex cap and the internal portion of the mandrel may be an obtuse angle or greater than 90° and an acute angle of less than 90°. In other embodiments wherein the cap is concave or convex, the closure may be perpendicular to the axis of the mandrel.

In preferred embodiments, the rotary valve 3 may be metal in design, the metal may be any metal or alloy known in the art that is sufficient to prevent the flow of hydrocarbons through the rotary valve when closed. In certain preferred embodiments, the metal is steel, iron or titanium. In preferred embodiments the metal is not reactive towards hydrocarbons. The rotary valve may be for example from 1 mm in thickness to several centimeters in thickness to account for any pressure from the hydrocarbon product. In alternative embodiments, the rotary valve may be composed of a plastic polymer, graphite, carbon nanotube, diamond, fiberglass, glass, a ceramic, concrete, or other mineral compounds.

In one embodiment, a mandrel with rotary valve 1 (closed position) is run in a casing string. The casing is cemented in the well. Optionally the cement has been weakened in the area of the valve parts. Cementing may be achieved by pumping cement down the casing string. The cement is supplied under pressure and consequently is squeezed up through the annular space between the casing and the wellbore until it reaches the bottom of the well casing when it passes up through the annular gap between the casing and wellbore. The cement rises up between casing and the wellbore.

Multiple valves are run in the casing with each being in a zone of interest when the casing is cemented in place. In one embodiment the mandrel with rotary valve 1, the rotary valve 3 is opened, the first production zone is fractured, drilling mud is flowed through the completed wellbore for clean up; and the rotary valve 3 is closed, wherein a hydrocarbon is produced up the production string. The same is done for each zone of production. Production tubing and packing is run and all valves are opened to comingle. The individual valves can be used to control flow. An advantage of embodiments of the present invention there is no impact on the formation of the opening and closing the reservoir as opposed to the standard method.

In one embodiment, a permanent gauge is run in each section at the outer diameter of the valve to test the pressure on the zone of interest after flowback.

There are many downhole applications where devices or "tools" are required to be actuated. It is typical for example for certain downhole tools to be run into position within the wellbore or well casing in a retracted or a "run-in" configuration and to be subsequently actuated such that they are in an engaged or "set" configuration. Other tools may be placed in service initially to perform a certain function and at a later time, or as a result of changed circumstances, it is desirable that they be actuated in order that they may perform an alternate function. For example, a valve may be initially open such that it allows well production, and later actuated to close and thus prevent wellbore production or vise versa. The broad variety of downhole tool applications has driven an equally diverse number of tool designs. However, many of these mechanical tools share the quality of having at least two mechanical states, a first before actuation and a second state subsequent to actuation. Actuation of these tools requires that mechanical work be done; that is a force needs to be applied over a displacement to move the tool from its first state to its second state. Such dual state tools are often characterized with certain components arranged and constrained such that the tool can be actuated so long as a force and its reaction can be made to be applied at specific component attachment points to cause a linear motion. The present invention is an actuator which is adaptable to many such dual state tools. The actuator's use is not constrained to any particular type of tool since it may be applied to any downhole tool that can be adapted to a linear actuator with the qualities described.

Methods of actuating downhole tools which have been placed wells include performing a through tubing intervention such as with a wire line where shifting tools are run into the well on wire line such that the shifting tool engages a profile within the tool. Subsequent and manipulation of the wire or use of a wire line setting tool can impart mechanical forces onto movable members of the downhole tool. However, it may not be possible or convenient to access the tool with a wire line as high well deviations can frustrate wire line operations. This limitation may be overcome with a less economical approach of using coiled tubing or a motorized tractor device. Regardless of whether coiled tubing, a motorized tractor device or a wire line, wellbore obstructions can frustrate these intervention operations.

Many tools are designed to be operated hydraulically and such tools normally contain piston arrangements and are operated when a differential pressure is imposed on the piston. Such tools are typically configured whereby a differential pressure from the wellbore tubing to a wellbore annulus is applied. The pistons in such tools are normally pinned or otherwise latched so that the tool is held in its first state until a prescribed threshold value of pressure differential is exceeded and once the threshold is exceeded the tool normally will partially actuate immediately but in most cases a still greater pressure is required to fully actuate the tool, for example a packer that may need very high pressures to be applied to fully pack off the sealing elements. For applications where it is desired to selectively activate multiple tools that are run in a well in tandem different threshold values may be used for each tool but this approach practically limits the number of tools that can be run in tandem. Furthermore a means of temporarily isolating the tubing from the annulus must often be employed. If the plugging means is to be installed or removed through the tubing obstruction limitations and conveyance limitations previously described can result. Differential pressure operated tools normally require that the additional pressure to cause the differential pressure is supplied by pumps at the surface which may not be readily available with sufficient capacity for such operations.

Downhole tools have been used that rely on atmospheric chambers to be used on one side of the piston such tools are often referred to as hydrostatically set. Hydrostatic set tools are normally designed such that the static pressure from the wellbore tubing or the wellbore annulus is sufficient to completely actuate the tool. In order to place these tools without prematurely actuating them the piston is normally locked down with a mechanical locking device made from solid materials such as alloy steel. The mechanisms are usually provided so that the required force applied to unlock the mechanism is relatively low compared to the force that the locking mechanism is retaining. This is a result of the fact that the piston within the tool is invariably subjected to the full differential between wellbore hydrostatic pressure and the atmospheric pressure on the opposite side of the piston. Since the piston seal must operate dynamically during the actuation phase where it required to stroke, such a seal has to be of a design compatible with dynamic movement and such seals will normally include resilient or elastomeric components. Such dynamic seals are often less reliable than seals designed for static applications or in particular static seals that involve metal contact only. While such dynamic seal designs may be adequate for typical operations, very small leak rates across such piston seals that may go undetected can cause the atmospheric chamber to be compromised and the tool to fail to fully actuate when required. Various means have been employed to release the piston locking mechanisms used in hydrostatic set tools. Typically this involves establishing a differential pressure from tubing to annulus and such an approach can suffer many of the same limitations as described for differential pressure operated tools.

Another configuration used for hydrostatic set tools is for the operating piston to be pressure balanced with atmospheric pressure on both sides of the piston. When actuation is desired, a wellbore fluid is made to enter one side of the operating piston to establish the differential pressure for tool operation. Such tools normally also suffer from the same problems of dynamic seals referenced previously, but in this case such seals typically define a barrier between the wellbore and one of the atmospheric chambers. Such systems may also suffer from the prospect of seal failure or slow leakage into the intended high pressure side of the piston which can cause premature tool actuation. This characteristic is not affected by the method intended for allowing the wellbore hydrostatic to be applied to the piston.

Various embodiments of the invention include a small diameter linear actuator device for use with a downhole tool that provides a system including a communications interface used for set up on surface or alternatively for connection to a downhole communication network. In an embodiment of the present invention, the system includes a programmable controller and actuation mechanism that produces an axial motion with relatively high force that can be used for reliably activate downhole mechanical tools. The system may use well bore hydrostatic pressure as the basis of the force generation or any other suitable basis for the force generation. In various embodiments of the invention, the system is modular and adaptable to various wellbore tool applications. In various embodiments of the invention, the actuator can be attached to a well tool to provide a stroking force to move or function an attached tool one time in one direction.

Various methods of actuating the valve actuator are possible. In an embodiment a battery pack is operably connected to the valve actuator. The battery pack can be used to supply power to all manner of actuation devices and motors, such as a pneumatic motor, a reciprocating motor, a piston motor, and/or the like. Alternatively, power may be supplied through the control line. In various further embodiments, the actuator is controlled by a control line from the surface. The control line can supply power to the actuator, supply a hydraulic fluid, supply light, fiber optics, and/or the like. In an embodiment, there are three control lines running to the actuator, such that one opens the actuator, one closes the actuator, and one breaks any cement that is capable of fouling the actuator and preventing it from opening. The cement on the actuator may be broken by any method common in the art such as vibration, an explosive charge, a hydraulic force, a movement up or down of the valve, and/or the like. Generally, any necessary structures for performing the vibrations, charges, movements, and/or the like can be housed in the mandrel about the valve.

In various embodiments, a piston is operably connected to the valve actuator 210 for rotating the rotary valve 3 between the open position and the closed position. In various further embodiments, a valve actuator at least partially opens the valve. Further embodiments comprise a valve actuator that is capable of selectively actuating the rotary valve to a desired position.

In various embodiments, components of an actuator system may include a measurement conduit and a check valve. The measurement conduit can be used for conveying any necessary instrumentation downhole, including, but not limited to a fluid, i-wire, a fiber optic cable, and/or any other instrumentation cable or control line for taking measurements, providing power, or device or tool necessary for operation of the system or operable with the system. Measurement devices conveyed down the measurement conduit can measure parameters including, but not limited to temperatures, pressures, fluid density, fluid depth and/or other conditions of fluids or areas proximate to or in various portions of the formation or wellbore. Additionally, fluids, chemicals, and/or other substances may be injected or conveyed downhole through the measurement conduit.

In various embodiments, a systems can include an actuator for opening, closing, rotating or otherwise controlling the orientation of the valves. The actuator can include one or more hydraulic actuators, electric actuators, mechanical actuators, combinations thereof or any other actuator capable of controlling the orientation of valves of a system. One or more umbilical can be run downhole from the surface to provide signals to the actuator to control the orientation of valves of a system.

In one embodiment the actuator is a hydraulic actuator for controlling the orientation of valves of a system. A system can further include one or more hydraulic umbilical through which a hydraulic power signal or force can be transmitted to the actuator from the earth surface. The actuator controls the orientation of valves of a system in response to the hydraulic power signal or force.

The hydraulic actuator can be configured to control the orientation of valves in response to a differential pressure between a pressure of a first hydraulic umbilical and a pressure at a point within the subterranean well. The hydraulic actuator can be configured to control the orientation of valves in response to a differential pressure between a pressure within a first hydraulic umbilical and a pressure within an injection conduit. The hydraulic actuator can be configured to control the orientation of valves in response to a differential pressure between a pressure within a first hydraulic umbilical and a pressure within the return conduit. The hydraulic actuator can be configured to control the orientation of valves in response to a differential pressure between a pressure within a first hydraulic umbilical and a pressure within a second hydraulic umbilical.

In various embodiments, a system can further include a gas holding chamber pre-charged with the injection gas for injecting gas through the injection conduit and into a container. The hydraulic actuator can be configured to control the orientation of valves in response to a differential pressure between a pressure within a first hydraulic umbilical and a pressure of the gas holding chamber.

In another embodiment, the hydraulic power signal can be sent through the gas injection conduit from the earth surface. The hydraulic actuator can be configured to control the orientation of valves in response to a differential pressure between a pressure within the gas injection conduit and a pressure at a point within the subterranean well. The hydraulic actuator can be configured to control the orientation of valves in response to a differential pressure between a pressure within the gas injection conduit and a pressure within the container. The hydraulic actuator can be configured to control the orientation of valves in response to a differential pressure between a pressure within the gas injection conduit and a pressure within the return conduit. The hydraulic actuator can be configured to control the orientation of valves in response to a differential pressure between a pressure within the gas injection conduit and a pressure within a hydraulic umbilical. The hydraulic actuator can be configured to control the orientation of valves in response to a differential pressure between a pressure within the gas injection conduit and a pressure within a gas holding chamber.

In yet another embodiment, the actuator is an electric actuator for controlling the orientation of valves of a system. The electric actuator can be a solenoid, an electric motor, or an electric pump driving a piston actuator in a closed-loop hydraulic circuit. A system can further include one or more electrically conductive umbilical through which an electric power signal can be transmitted to the actuator from the earth surface. The actuator controls the orientation of valves of a system in response to the electric power signal.

In one embodiment, an actuator for controlling the orientation of valves of a system includes a communications receiver for receiving a communication signal, a local electrical power source for powering the actuator, a controller responsive to the communication signal, and a sensor interfaced with the controller for providing an indication of the presence of at least one subterranean fluid to be removed from a the subterranean well.

In one embodiment, the receiver is an acoustic receiver and the communication signal is an acoustic signal generated at an earth surface, a wellhead of the subterranean well or other remote location. In another embodiment, the receiver is an electromagnetic receiver and the communication signal is an electromagnetic signal generated at earth surface, a wellhead of the subterranean well or other remote location.

The local electrical power source for powering the actuator is can be a rechargeable battery, a capacitor, or an electrically conductive cable energized by a power supply located at earth surface, a wellhead of the subterranean well or other remote location.

In various embodiments, the controller of the actuators of the present disclosure can include a programmable microprocessor. The microprocessor can be programmed to operate the actuator and control the orientation of valves in response to the communication signal received by the receiver.

In an embodiment of the present invention, the actuator may contain a sensor. The sensor may be used to sense heat, pressure, light, or other parameters of the subterranean well or wellbore. In one embodiment the sensor includes a plurality of differential pressure transducers positioned in the subterranean well at a plurality of subterranean depths.

Figure 7:
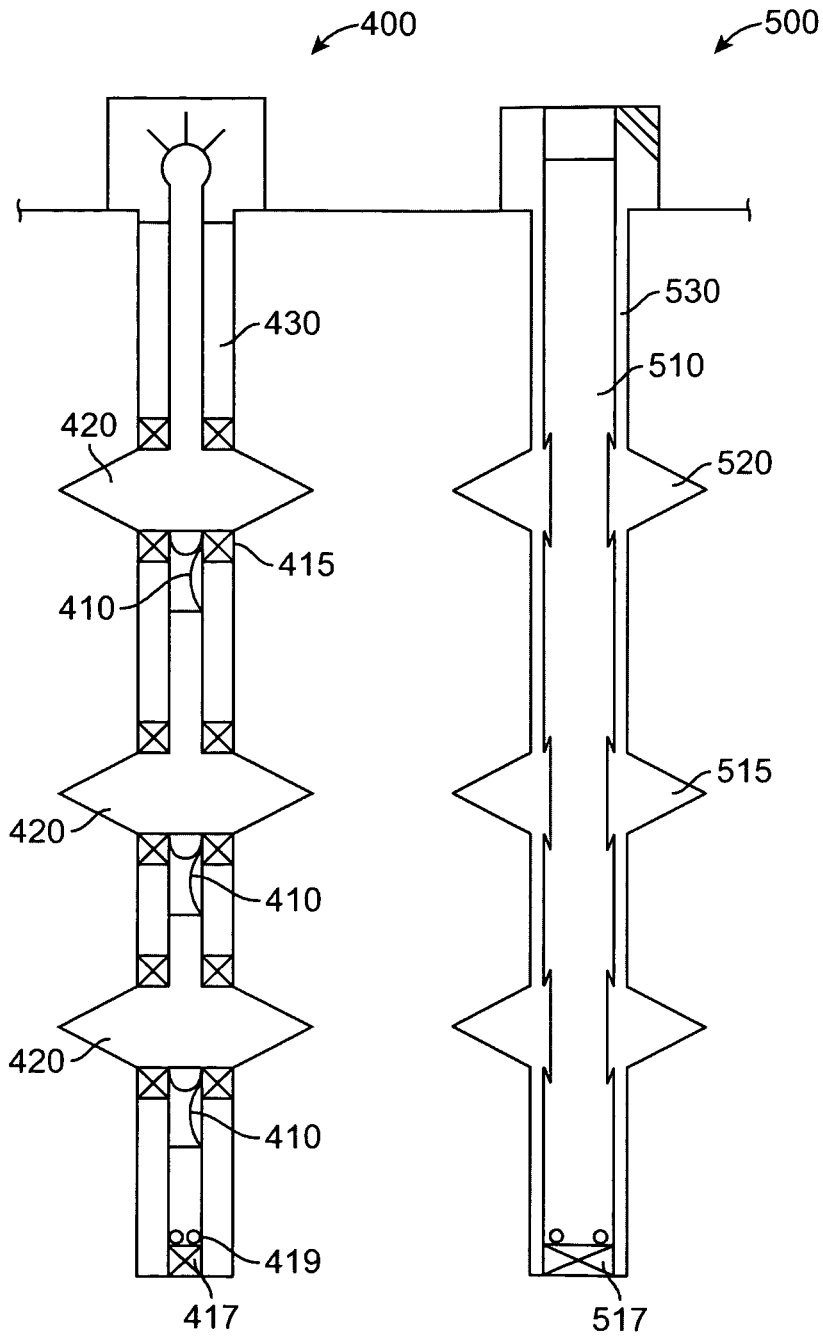
FIG. 7 is an illustration of two wellbore completions.

Referring to FIG. 7, two well completions are illustrated. Well completion 400 is an illustration of multiple valve tools 410, multiple production zones 420, ports 419, packers 415, cemented section 430, and bottom sub or packer 417. Well completion 500 is an illustration of a casing string section 510, production zones 520, cemented section 530, rotary sleeve 515, and packed section 517.

In an embodiment, with reference to FIG. 7, two different systems are disclosed for solving a common problem.

Wellbore 400 illustrates a system whereby a wellbore 430 was drilled and fractured. Multiple valve tools 410 are run in the casing abutting a production zone in a closed position. On signal or at a predetermined time, each valve on at least one of valve tool 410 is opened to allow production. Various arrangements of the valve tools are capable of use with varying embodiments of the present invention, such as a valve tool positioned both uphole and downhole from a formation for the production of oil and gas.

Wellbore 500 illustrates a system whereby a wellbore 530 was drilled. A rotary valve tool, comprising a rotary valve sleeve, is then run into the wellbore along with casing. In various embodiments, the rotary valve tool is aligned with a zone for production. In various embodiments, after running of the casing and the rotary valve tool, cement is flowed into the annular space, but not in the area from which production is desired. To begin production, the rotary valve is actuated and the rotary valve tool exposes a communication pathway from the interior of the wellbore to the formation. Fracturing of the formation can then occur through the communication pathway.

A well completion system comprising of a at least one casing mounted rotary valve wherein the casing is cemented in place except for the annular space exterior to the rotary valve The system of claim 1 wherein the at least one rotary valve is controlled from the surface through an at least one hydraulic line cemented in place.

The method of completing a well with the completion system of claim 2 comprising the steps of:

running the at least one casing mounted rotary valve to depth in the closed position, such rotary valve incorporating an annular fluid bypass means. between two casing mounted packers;

actuating the packers, cementing the casing in place and forcing the cement to pass through the annular bypass means and thus not creating a seal against the formation in the section outside the rotary valve and between the two packers; and opening the rotary valve to establish wellbore communication with the reservoir The method of claim wherein at least two rotary valves are included in the casing string and further comprising the steps of;

injecting stimulation fluid from wellbore into the formation through the first valve; producing fluid from the formation through the first valve;

closing the first valve;

opening the second; and injecting stimulation fluid from wellbore into the formation through the second valve.

In various embodiments, a method of completing a well comprising of the following steps is disclosed:

cementing a casing string in place; perforating a first zone at a first depth; injecting stimulation fluid from the wellbore into the formation through the perforations in the first zone;

producing fluid from the first zone of the formation; running a packer mounted valve in a closed position above the perforations of the first zone, such valve including a timed delayed programmable actuator; setting the packer and valve within the casing to pressure isolate the wellbore above the valve from the formation in the first zone; perforating a second zone at a second depth that is shallower than the valve placement depth; injecting stimulation fluid from the wellbore into the formation through the perforations in the second zone; producing fluid from the second zone of the formation;

allowing the valve to automatically open upon the expiration of the time programmed in the valve actuator to allow both zones to communicate.

In various embodiments, the actuator as designed is for single shot operation. The actuator may be attached to a well tool to provide a stroking force to move or function an attached tool one time in one direction.

Preferably, an actuator module is used with a downhole tool. The actuator module may provide a method for selectively operating the downhole tool by delivering a force through a displacement. In certain embodiments, the actuator module may be attached to the downhole tool. In other embodiments, it may be incorporated into a downhole tool. Preferably, the force delivered is derived from the full hydrostatic wellbore pressure acting across a piston. Preferably, prior to activation the piston is supported by a fixed volume of fluid at hydrostatic pressure. Upon actuation, the fluid may be allowed to be evacuated into a separate atmospheric chamber.

Figure 8A:
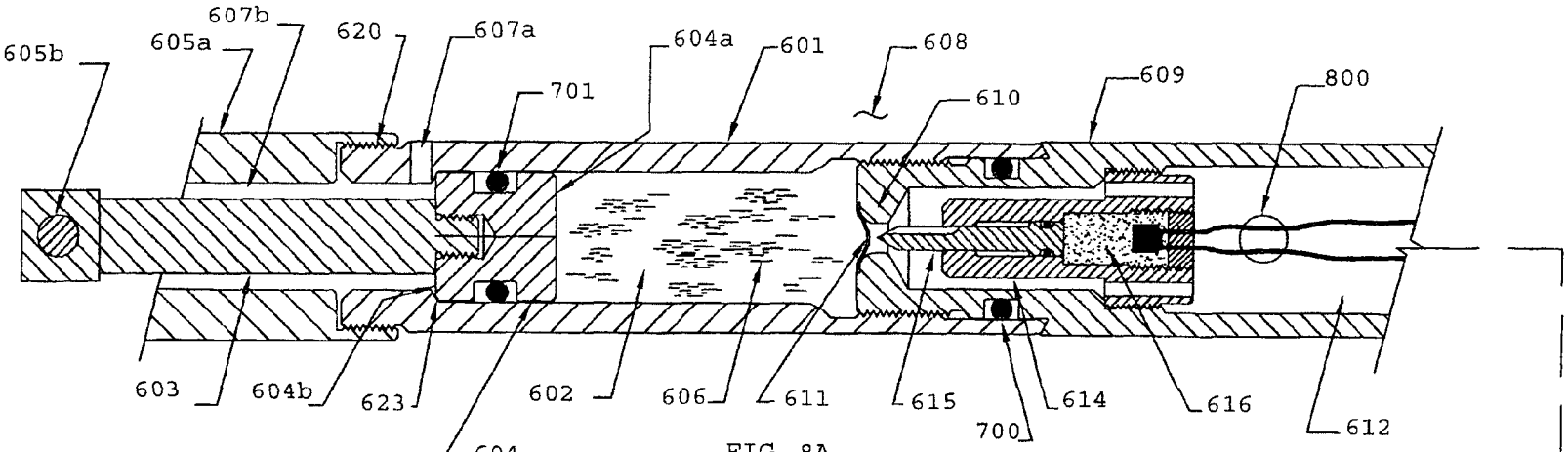
FIGS. 8A and 8B are illustrations of the actuator device in its pre activated state.
Figure 8B:
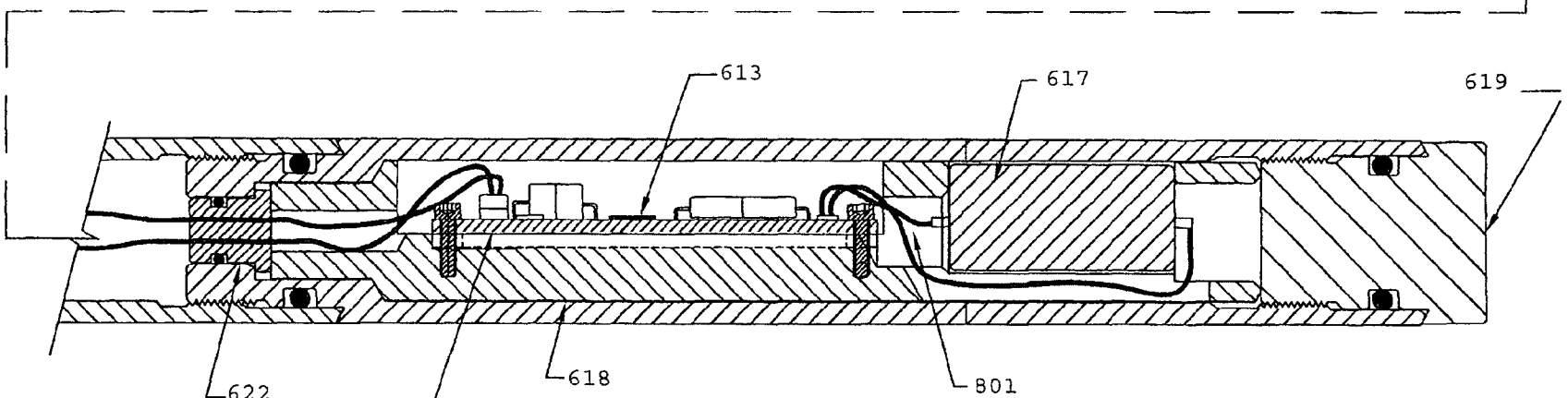

FIG. 8A and FIG. 8B show a preferred embodiment of the device in its pre activated state. The device is to be connected to a downhole tool at two points. One point of connection must be linked to the actuator piston 604; the linkage member 603 provides this functionality. The other point of connection is shown to be at the threaded end 620 of the housing 601. One operating member of the downhole tool is shown as 5A, and is configured in this instance as a threaded cylinder. The second operating member of the downhole tool is shown as item 5B, and in this instance is configured as a pin.

A flow path means including hole 607A and annular space 607B is provided for allowing the wellbore fluid 608 to communicate with the one side piston 604B and linkage member 603.

A fixed volume of incompressible fluid 606 is contained in a cylindrical chamber 602. The chamber 602 is defined by the housing 601, side 604A of piston 604, a disk 611, and a disk support member 610. O-ring 700 installed between the disk support member 610 and engaging the housing 601 as well as second o-ring 701 installed in piston 604 and engaging the piston isolate the fluids 606 in the cylindrical chamber 602 from fluids in the wellbore 608. However, it may be seen that since piston 604 is exposed to well bore fluids 608 on piston side 604B that the pressure in the chamber 602 will also be at hydrostatic pressure and therefore in this pre-actuated state, o-ring 700 and 701 are not subject to differential pressure. A second atmospheric chamber 612 is isolated from the first cylindrical chamber 602 by disk 611 and disk support member 610 which are both constructed of alloy steel in the preferred embodiments.

A separate section of the tool contains a printed circuit board 621 or PCBA mounted to chassis 618. The PCBA 621 includes many electrical components which in the preferred embodiment the PCBA 621 include a micro-processor/microcontroller based controller 613 and onboard vibration and temperature sensors as well as various connection means. Also shown is a power source 617 in this instance configured as a battery. Wire set 800 provides a connection between the controller 613 and an opening module 614 which provides a means of controller generated output signal to be delivered to the opening module. Second wire set 801 provides the means of powering the PCBA components and controller 613 from the power source 617. Bulkhead 622 provides a pressure barrier between the section of the tool containing the controller 613 and the second atmospheric chamber 612. This bulkhead 622 allows for the controller to remain active after activating the opening module and actuating the device especially when the incompressible fluid 602 is a conductive fluid. The separation that bulkhead 622 provides may be omitted where it is not necessary that the controller 613 continue to operate after actuation.

Opening module 614 is shown mounted within the isolation module 609. In this instance the opening module 614 shown is pyrotechnically activated it includes a contained amount of pyrotechnic material 616. Shown in its pre activated state the cutting dart 615 is not in contact with disk 611.

End cap 619 is shown which provides pressure isolation between the wellbore 608 and the interior of the tool containing the power source 617 and PCBA 621.

In this pre-actuated condition the piston 604 and linkage member 603 are limited from moving into the housing 601 by the reactive force provided by the incompressible fluid 602. Also shown is shoulder 623 of housing 601 which limits movement of the piston 604 and linkage member 603 from being retracted from the housing 601.

Figure 9A:
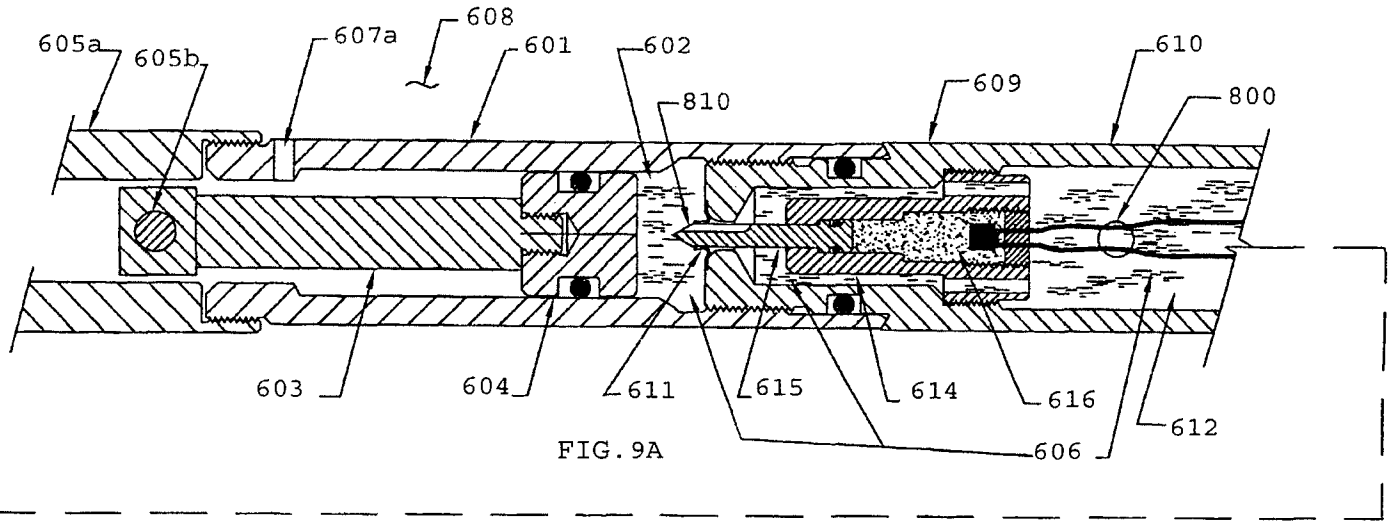
FIGS. 9A and 9B are illustrations of the actuator device in its activated state.
Figure 9B:
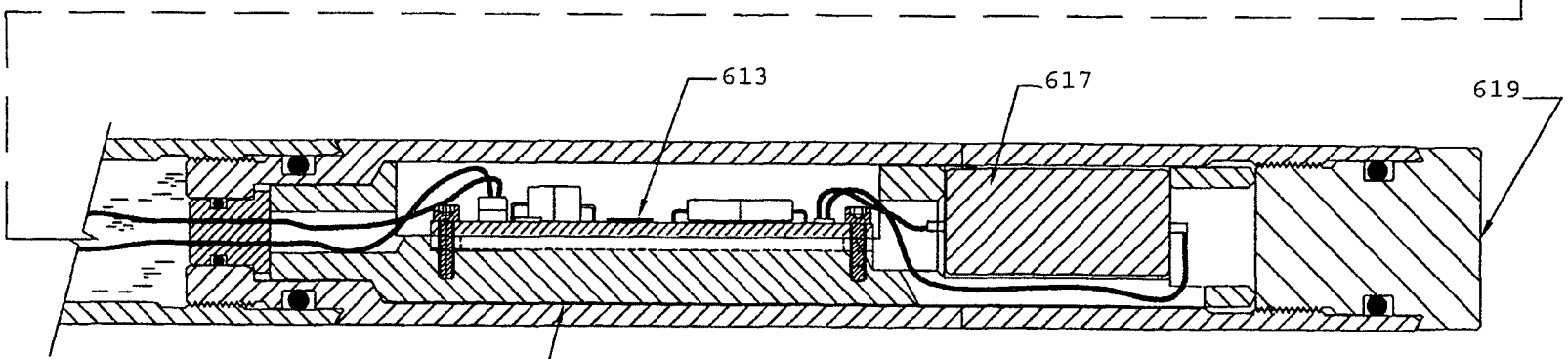

FIGS. 9A and 9B show a preferred embodiment of the device in its activated state. Just prior to this state, conditions set within a program running on the controller 613 were satisfied such that the controller 613 generated an electrical output signal to activate the opening module 614. In this instance electric output of the controller provided sufficient current through the wire set 800 to the pyrotechnic material 616 in the opening module 614 to cause the material 616 to ignite and generate pressure driving the cutting dart 615 with force to puncture disk 611. The cutting dart 615 is designed to include a linear grove 810 such that in the event that it does not retract from the perforated hole, a fluid communication path 810 between the cylindrical chamber 602 the second atmospheric chamber 612 is provided for the compressible fluid 606 to pass. In this condition the piston 604 and linkage member 603 have been retracted into the housing 601 by the well hydrostatic forces acting against the piston 604. The associated relative movement of the downhole tool operating members 605A and 605B cause the downhole tool to operate.

Figure 10B:
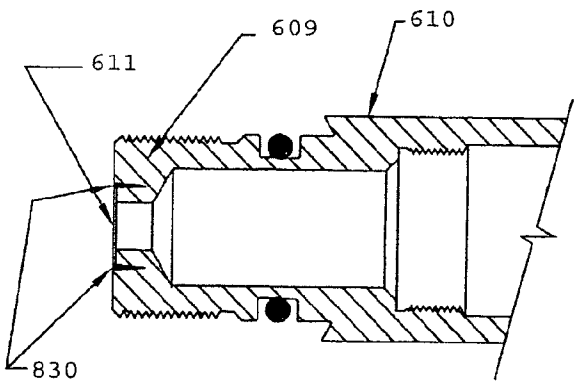
FIGS. 10B and 10C are illustrations of the isolation module with a disk welded to a face of a support member.
Figure 10A:
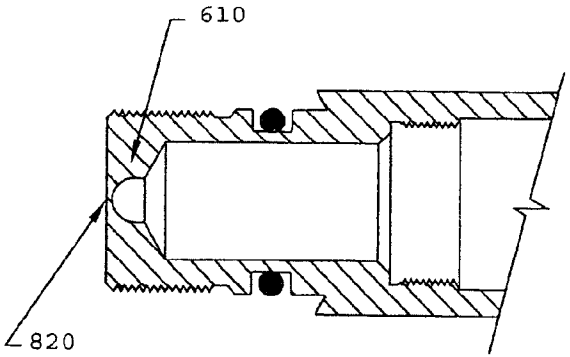
FIG. 10A is an illustration of an isolation module with an integral thin target section.

FIG. 10A Shows and Isolation module 610 with integral thin target section 820.

FIG. 10B Shows Isolation module 610 with a disk 611 welded 830 to a face of a support member 609. The weld 830 is preferably done with an electron beam process. This arrangement is often preferable to that shown in FIG. 11A because more precise mechanical properties are obtainable from the use of a disk 611 than an integral thin section 820 in FIG. 3A.

Figure 10C:
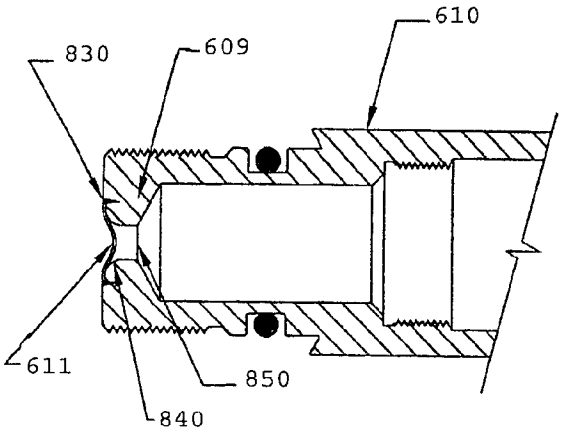

FIG. 10C Shows Isolation module 610 with a disk 611 welded 830 to a face of a support member 609. The weld 830 is preferably done with an electron beam process. A diverging radii 840 is shown at the interface between the hole 850 provided in the support member 609 and disk 611. The disk 611 is shown to be partially pre-formed against the radii 240. Pre-forming as such in assembly and the additional support that the radii 840 gives the disk 611 has been shown to improve the reliability of the disk 611 to sustain certain high differential pressures.

Figure 11A:
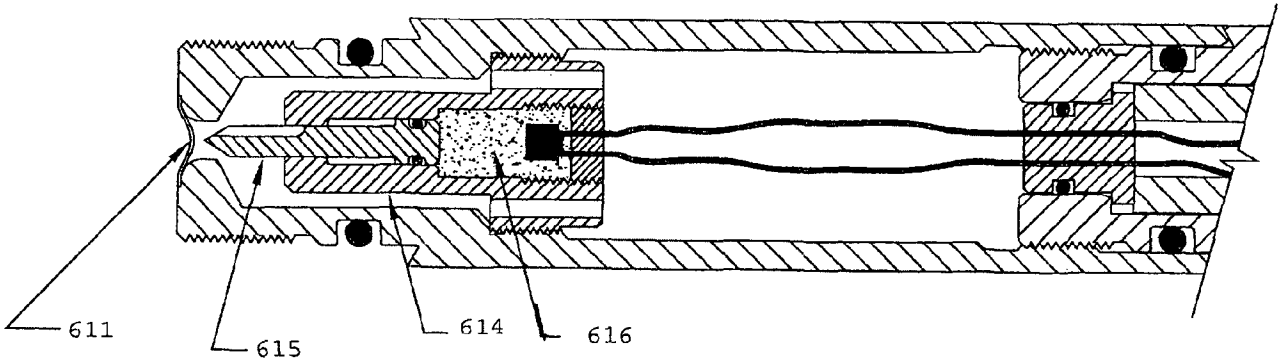
FIG. 11A is an illustration of a pyrotechnic driven opening module prior to actuation.

FIG. 11A Pyrotechnic driven opening module 614 prior to actuation shown with cutting dart 615 retracted and pyrotechnic charge 616 prior to activation.

Figure 11B:
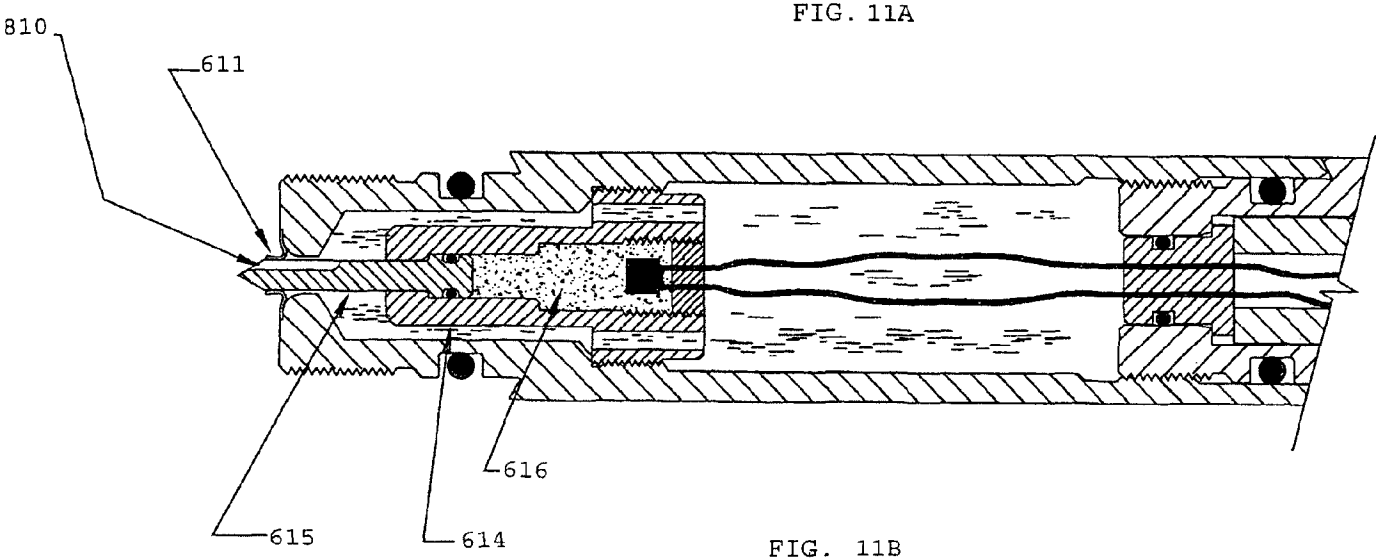
FIG. 11B is an illustration of a pyrotechnic driven opening module after actuation.

FIG. 11B Pyrotechnic driven opening module 614 after actuation shown with cutting dart 615 extended and perforating through disk 611 and providing flow path 610 and pyrotechnic charge 616 expanded and under pressure after activation.

Figure 12A:
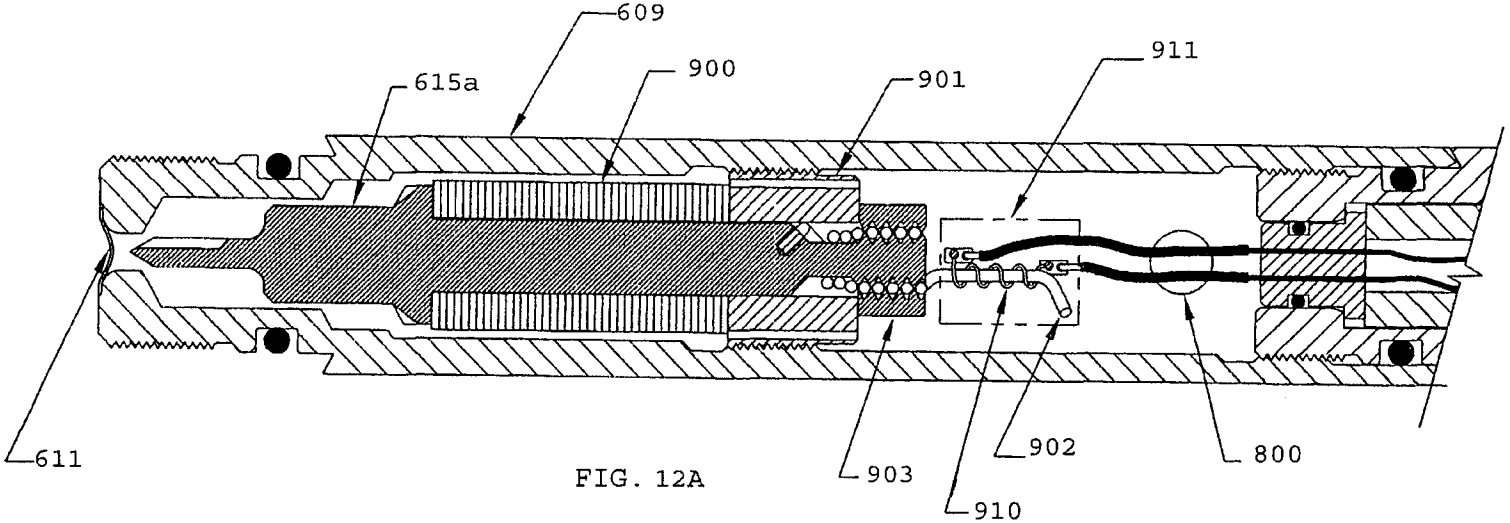
FIG. 12A is an illustration of a spring driven bimetallic fuse wire activated opening module installed into an isolation module before device actuation.

FIG. 12A Shows a spring 900 driven bimetallic fuse wire 902 activated opening module 901 installed into an isolation module 609 before device actuation. Cutting dart 615A is held off disk 611 by a bimetallic wire retainer 902. Such a wire 902 is exemplified by a material manufactured by the Sigmund Cohn Corp of Mount Vernon, N.Y. known by the trademark of PYROFUZE®. Wire retainer 902 is shown placed within helical grooves on cutting dart 615A and a solid ring 903. Spring 900 is in a compressed state. Heating element 910 is shown to be in intimate thermal contact with the wire retainer 902 within a volume of insulated potting material 911.

Figure 12B:
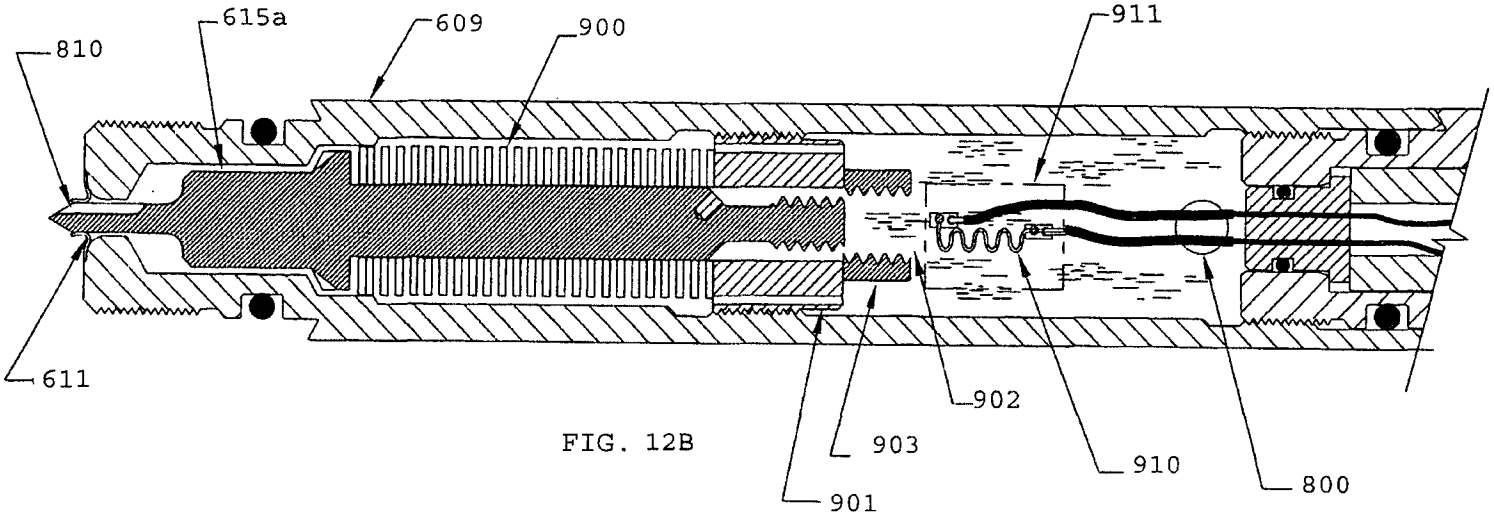
FIG. 12B is an illustration of a spring driven bimetallic fuse wire activated opening module installed into an isolation module after device actuation.

FIG. 12B Shows a spring 900 driven bimetallic fuse wire (shown in FIG. 12A as item 902) activated opening module 901 installed into an isolation module 609 after device actuation. In this view deflagration of wire retainer 902 has occurred (and so it is no longer visible) in response to the heat generated by the current of the controller's electrical output signal delivered through wire set 800 to heating element 910 which was originally contacting the wire retainer. With the wire no longer present in solid form, dart 615A no longer constrained and is released to respond to the spring force with motion, spring 900 is shown to have forced the dart to move and to perforate disk 611.

Figure 13A:
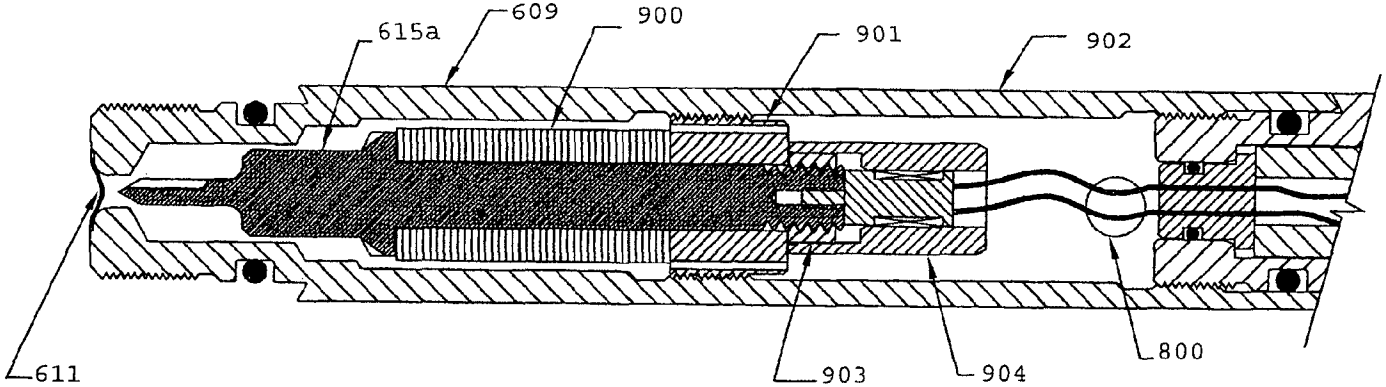
FIG. 13A is an illustration of a spring driven solenoid activated opening module installed into an isolation module prior to device actuation.

FIG. 13A Shows a spring 900 driven solenoid activated opening module 901 installed into an isolation module 609 prior to device actuation. Cutting dart 615A is held off disk 611 by a threaded and split retainer 903 and the solenoid sleeve 904. Spring 900 is in a compressed state.

Figure 13B:
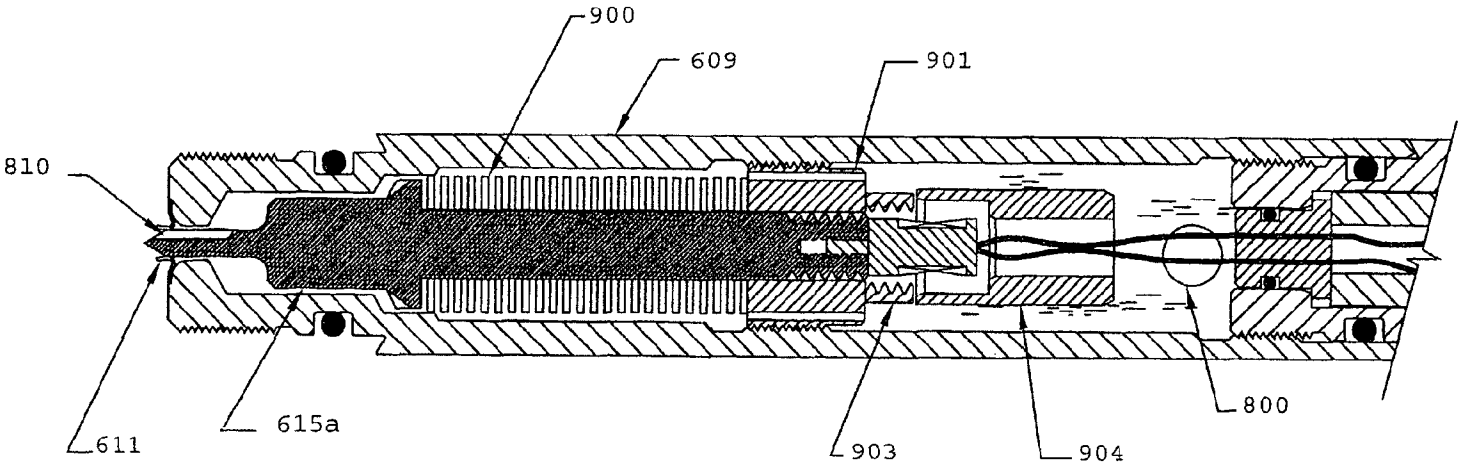
FIG. 13B is an illustration of a spring driven solenoid activated opening module installed into an isolation module after device actuation.

FIG. 13B Shows a spring 900 driven solenoid activated opening module 901 installed into an isolation module 609 after device actuation. In this view the retainer support member 904 has been driven linearly off of the split retainer 903 in response to a magnetic force produced from the current in conductor set 800 provided by a controller. Split retainer 903 no longer constrained by the solenoid sleeve 904 is permitted to disengage radially out ward from threaded engagement of the cutting dart 615A. With dart 615A no longer constrained, spring 900 is shown to have forced the dart to move and to perforate disk 611.

Figure 14:
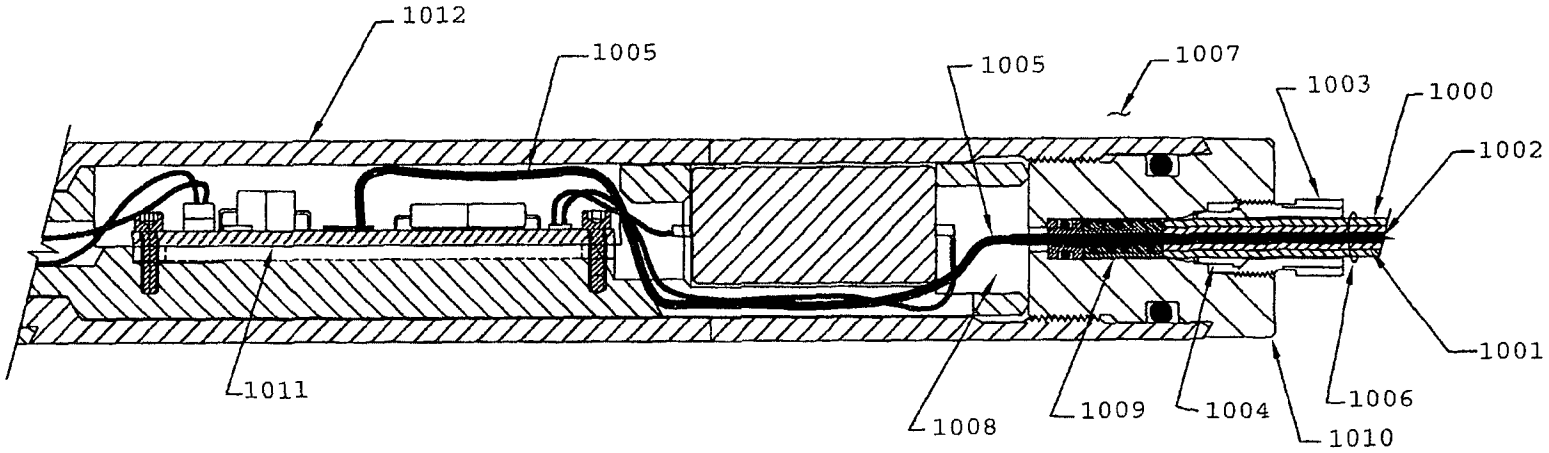
FIG. 14 is an illustration if an interface to electrically conductive instrument wire or (I-wire) cable assembly.

FIG. 14 Shows an interface to electrically conductive instrument wire or (I-wire) cable assembly. I-wire cable assemblies 1006 are commonly used for transmitting communication and low power signals between surface and downhole devices. These are cable assemblies constructed within a stainless steel metal tube 1000 which are normally 0.250 inches or 0.125 inches in outer diameter. An insulation layer 1001 is used to isolate the conductor cable 1002. A set of metal ferrule seals 1004 are energized by a jam nut 1003 to seal between the tube 1000 and tool end cap 1010 which isolates the wellbore fluid 1007 from the interior of the tool 1008. The conductive cable is conductively attached to a feed through within a bulkhead insulator 1009. A cable assembly wire 1005 is also conductively connected to the feed through within the bulkhead insulator 1009 and connected as required to connections points within the I-Wire cable assembly PCBA 1011. Depending on the application wire 1005 can service a transceiver or a power supply among other functional components. An electrical power and communication circuit can be established with a common ground including the I-Wire cable assembly device body 1012 and the stainless tubing body 1000.

Figure 15A:
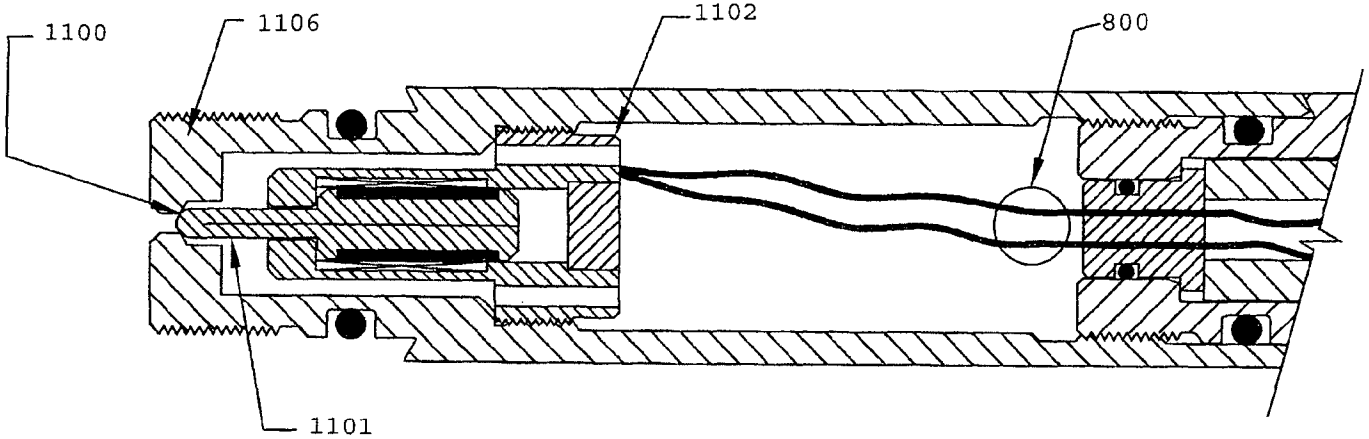
FIG. 15A is an illustration of a solenoid valve based opening module in the pre-actuated state.

FIG. 15A Shows a solenoid valve based opening module 1102 in the pre-actuated state. Opening module 1102 contains a normally extended valve stem 1101, which in this view is sealed on and engaged by an internal spring against a valve seat 1100 in the isolation module 1106.

Figure 15B:
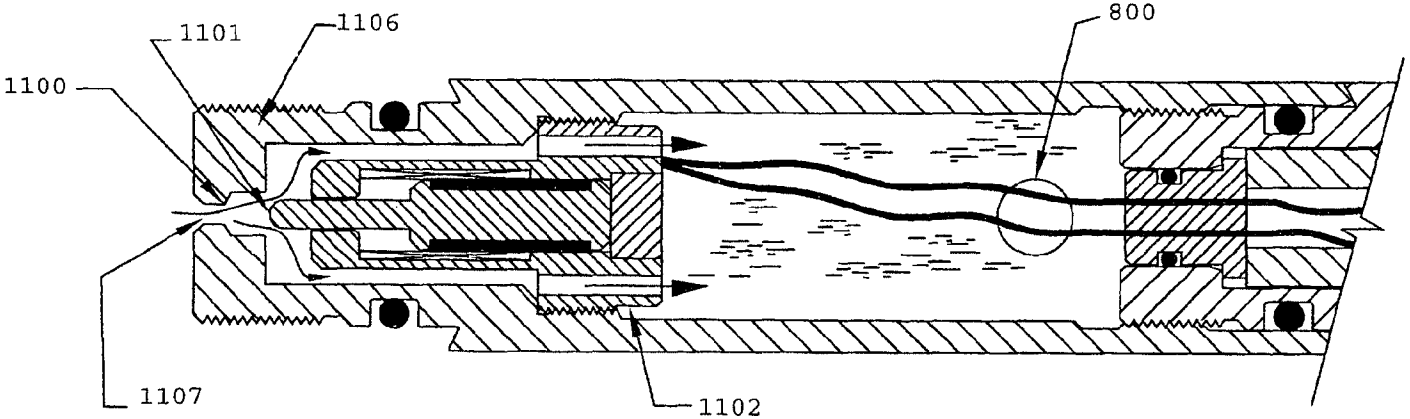
FIG. 15B is an illustration of a solenoid valve based opening module in the after actuation.

FIG. 15B Shows a solenoid valve based opening module 1102 after actuation. Upon activation of the solenoid valve 1102, by the electrical signal provided through wire set 800, the valve stem 1101 retracts from the valve seat 1100 providing a fluid communication path 1107 across the isolation module 1106.

From the foregoing description, one skilled in the art can easily ascertain the essential characteristics of this disclosure, and without departing from the spirit and scope thereof, can make various changes and modifications to adapt the disclosure to various usages and conditions. The embodiments described hereinabove are meant to be illustrative only and should not be taken as limiting of the scope of the disclosure, which is defined in the following claims.

What is claimed is:

1. A mandrel for isolating production zones in a wellbore, the mandrel defining a through passage smaller than an exterior portion of the mandrel comprising:

a) a blapper valve operatively connected to the mandrel;

b) a valve actuator, the valve actuator comprising:

i. a piston chamber separate from the through passage;

ii. a piston with a first side oriented toward the valve and a second side oriented away from the valve, the piston being disposed within the piston chamber;

iii. an incompressible fluid between the second side of the piston and a pressure barrier, the pressure barrier being positioned between the incompressible fluid and a compressible gas and;

wherein upon breach of said pressure barrier the piston moves within the piston chamber and the blapper valve can be actuated into at least a first position wherein said blapper valve is open and said through passage is open or at least a second position wherein said blapper valve is closed and said through passage is closed.

2. The mandrel of claim 1, further comprising a battery pack operably connected to said valve actuator.

3. The mandrel of claim 1, further comprising a control wire running downhole to the actuator for controlling the actuator.

4. A completed wellbore with at least a first production zone, said completed wellbore further comprising a cemented casing string, a production string, a fracture valve tool and a mandrel of claim 1 connected to said production string and positioned above said first production zone.

5. A process for producing a hydrocarbon from the completed wellbore of claim 4, said process comprising the steps of: a) opening said blapper valve; b) fracturing said first production zone; and, c) flowing a drilling mud through said completed wellbore for cleanup, wherein a hydrocarbon is produced up said production string.

6. The mandrel of claim 1, wherein the valve actuator is actuated by a pyrotechnic charge.

7. The mandrel of claim 1, wherein the valve actuator is actuated by a spring.

8. The mandrel of claim 1, wherein the valve actuator is actuated by a solenoid.

9. A fracture valve tool for running in a wellbore and isolating production zones in said wellbore, said fracture valve tool comprising a mandrel comprising at least a first open end and a second open end; a blapper valve, wherein said blapper valve is attached to at least one of said first open end and said second open end of said mandrel; and, an actuator comprising:

a) a piston chamber separate from the through passage;

b) a piston with a first side oriented toward the valve and a second side oriented away from the valve, the piston being disposed within the piston chamber;

c) an incompressible fluid between the second side of the piston and a pressure barrier, the pressure barrier positioned between the incompressible fluid and a compressible gas and;

wherein upon breach of the pressure barrier said actuator opens or closes the position of said blapper valve and wherein a piston or a shaft is operably connected to said actuator for rotating said blapper valve between said open position and said closed position.

10. The fracture valve tool of claim 9, wherein said mandrel is connected to one of a casing string or a production string.

11. The fracture valve tool of claim 9, wherein said fracture valve tool is cemented in a wellbore.

12. The fracture valve tool of claim 9, wherein said fracture valve tool is cemented in a closed position.

13. The fracture valve tool of claim 9, wherein said fracture valve tool is cemented in an open position.

14. The fracture valve tool of claim 9, wherein said fracture valve tool is cemented above or below an oil and gas formation.

15. The fracture valve tool of claim 9, wherein said fracture valve tool is cemented above an oil and gas formation.

16. The fracture valve tool of claim 9, wherein said actuator is designed to open or close said blapper valve upon receiving a signal.

17. The fracture valve tool of claim 9, further comprising at least one packer.

18. A completed wellbore comprising the fracture valve tool of claim 9.

19. The fracture valve tool of claim 9, wherein said actuator is designed to open or close said blapper valve at a predetermined time.

* * * * *